US007828415B2

(12) United States Patent
Kawamura

(10) Patent No.: US 7,828,415 B2
(45) Date of Patent: Nov. 9, 2010

(54) INK CARTRIDGE HOLDING DEVICE

(75) Inventor: Hiroki Kawamura, Nisshin (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 777 days.

(21) Appl. No.: 11/692,900

(22) Filed: Mar. 28, 2007

(65) Prior Publication Data

US 2007/0229621 A1 Oct. 4, 2007

(30) Foreign Application Priority Data

Mar. 31, 2006 (JP) ..... 2006-100511

(51) Int. Cl.
*B41J 2/14* (2006.01)
*B41J 2/175* (2006.01)

(52) U.S. Cl. ..... 347/49

(58) Field of Classification Search ..... 347/49, 347/50, 84, 85, 86, 87
See application file for complete search history.

(56) References Cited

U.S. PATENT DOCUMENTS

| | | | | |
|---|---|---|---|---|
| 5,512,926 | A | 4/1996 | Uchikata et al. | |
| 6,190,010 | B1 * | 2/2001 | Tanaka | 347/108 |
| 6,250,750 | B1 * | 6/2001 | Miyazawa et al. | 347/87 |
| 6,276,780 | B1 | 8/2001 | Carrese et al. | |
| 6,276,789 | B1 | 8/2001 | Miyazaki et al. | |
| 6,293,662 | B1 | 9/2001 | Shihoh et al. | |
| 6,371,586 | B1 * | 4/2002 | Saruta | 347/7 |
| 6,502,917 | B1 | 1/2003 | Shinada et al. | |
| 6,655,793 | B2 * | 12/2003 | Jones et al. | 347/86 |
| 6,736,486 | B2 * | 5/2004 | Nakamura et al. | 347/49 |
| 6,863,388 | B2 * | 3/2005 | Seino et al. | 347/86 |
| 7,452,066 | B2 * | 11/2008 | Tsuji | 347/108 |
| 2002/0085075 | A1 | 7/2002 | Shinada et al. | |
| 2002/0140778 | A1 | 10/2002 | Yoshiyama et al. | |
| 2004/0196333 | A1 | 10/2004 | Yoshiyama et al. | |

FOREIGN PATENT DOCUMENTS

JP H05-162323 A 6/1993

(Continued)

OTHER PUBLICATIONS

Japan Patent Office; Notification of Reason for Refusal in Japanese Patent Application No. 2006-100511 mailed May 11, 2010.

*Primary Examiner*—Anh T. N. Vo
(74) *Attorney, Agent, or Firm*—Baker Botts L.L.P.

(57) ABSTRACT

An ink cartridge holding device for holding an ink cartridge includes a holder holding the ink cartridge and having an opening so as to allow the ink cartridge to be inserted thereinto and withdrawn therefrom through the opening, a door which is attached to the holder and is pivotable between (a) an open position at which the opening is uncovered for permitting insertion and withdrawal of the ink cartridge through the opening into and from the holder and (b) a closed position at which the opening is covered for inhibiting the insertion and withdrawal of the ink cartridge through the opening, a locking member which is attached to the door for locking the door at the closed position, and an interference preventing portion which is provided at the door for preventing an interference of the locking member with the withdrawal of the ink cartridge when the door is placed at the open position.

12 Claims, 21 Drawing Sheets

FOREIGN PATENT DOCUMENTS

| | | | |
|---|---|---|---|
| JP | H08-310010 | A | 11/1996 |
| JP | H10-024607 | A | 1/1998 |
| JP | H11-198391 | A | 7/1999 |
| JP | H11-320914 | A | 11/1999 |
| JP | H11-348303 | A | 12/1999 |
| JP | 2000-238282 | A | 9/2000 |
| JP | 2002-019142 | A | 1/2002 |
| JP | 2002-166569 | A | 6/2002 |
| JP | 2002-166573 | A | 6/2002 |
| JP | 2002-210996 | A | 7/2002 |
| JP | 2002-234179 | A | 8/2002 |
| JP | 2002-254670 | A | 9/2002 |
| JP | 2002-254673 | A | 9/2002 |
| JP | 2003-053999 | A | 2/2003 |
| JP | 2003-266732 | A | 9/2003 |
| JP | 2005-067168 | A | 3/2005 |

* cited by examiner

INK CARTRIDGE HOLDING DEVICE

The present application is based on Japanese Patent Application No. 2006-100511 filed on Mar. 31, 2006, the contents of which are incorporated herein by reference.

BACKGROUND OF THE INVENTION

1. Field of the Invention

The present invention relates to a structure of an ink-jet recording apparatus permitting at least one ink cartridge mounted thereon to be replaced, and more particular to a structure of an ink cartridge holding device which holds the at least one ink cartridge.

2. Discussion of Related Art

In an ink-jet recording apparatus, an ink droplet or ink droplets are selectively ejected from a recording head onto a recording medium, e.g., a recording sheet, based on an image data, so that an image is recorded on the recording medium. In the ink-jet recording apparatus described above, ink is normally pre-stored in a cartridge-type ink tank (hereinafter, abbreviated as "an ink cartridge"), and supplied from the ink cartridge to the recording head. Generally, depending on a manner of supplying the ink from the ink cartridge to the recording head, types of the ink-jet recording apparatus are roughly classified into following two types: so-called an "ON carriage type" and an "OFF carriage type".

In the ink-jet recording apparatus classified as the "ON carriage type" the ink cartridge is directly mounted on a carriage which is equipped with the recording head and which is reciprocatable above the recording sheet, so that the ink is supplied from the ink cartridge to the recording head. In the recording apparatus classified as the "OFF carriage type", the ink cartridge is disposed on a portion located inside or outside of a body of the ink-jet recording apparatus. In this arrangement, the ink cartridge is connected, via a flexible ink supply tube, to the recording head in full time, so that the ink is supplied from the ink cartridge to the recording head.

Further, there is another "OFF carriage type" ink-jet recording apparatus in which the ink cartridge is temporarily connected to the recording head via a connecting means provided on a specific position in the ink-jet recording apparatus when the recording head is moved to the above-indicated specific position, so that the ink is supplied from the ink cartridge to the recording head. It is noted that, in order to simplify a description, an "OFF carriage type" ink-jet recording apparatus to be described hereinafter is classified as the above-described "OFF carriage type" in which the cartridge is connected, via the flexible ink supply tube, to the recording head in full time, so that the ink is supplied from the at least one ink cartridge to the recording head.

In the above-described ink-jet recording apparatus classified as the "OFF carriage type", there is provided an accommodating portion for accommodating the ink cartridge, usually having a case which is provided therein for holding and stabilizing the ink cartridge. The case is connected to the recording head via the ink supply tube, etc. Further, an ink supply needle is provided inside of the case. The ink supply tube and the ink supply needle, etc., cooperatively define an ink supply channel for connecting the ink cartridge to the recording head.

In the state in which the ink cartridge is hold and stabilized by the case, the ink supply needle is inserted into an ink supply portion of the ink cartridge. In this state, the ink cartridge is connected to the ink supply channel, whereby the ink is supplied from the ink cartridge to the recording head via the ink supply channel. In this arrangement, the ink cartridge and the case are pre-constructed together as a unit which is to be set in the above-described accommodating portion of the ink-jet recording apparatus. The unit is particularly defined as a "refill unit".

In the ink-jet recording apparatus described above, if the ink stored in the ink cartridge is used up or consumed until a nearly-empty state, the ink cartridge needs to be replaced with a new ink cartridge. If volume of the ink cartridge is small, frequency of replacing the ink cartridge is increased.

It is troublesome for the operator to replace the ink cartridge. Also, there is a risk of ink leakage when the ink cartridge is replaced by the operator, due to a bad construction of the ink-jet recording apparatus or poor handling ability of the operator. Therefore, the increased frequency of replacing the ink cartridge results in increased tasks for the operator and increased risk of the ink leakage. Thus, in order to decrease the frequency of replacing the ink cartridge, it is required for the ink-jet recording apparatus to be equipped with an ink cartridge having large volume.

An example of a large-sized ink-jet recording apparatus which includes the ink cartridge having large volume is disclosed in Japanese Unexamined Patent Application Publications JP-A-2002-166573 and JP-A-2002-166569. The large-sized ink-jet recording apparatus also includes a plurality of leg portions for supporting a box-like body thereof.

In the large-sized ink-jet recording apparatus disclosed in the above-described Japanese Unexamined Patent Application Publications JP-A-2002-166573 and JP-A-2002-166569, a case for accommodating ink cartridges is set in an accommodating portion located on a front side of the box-like body. A cover which can be opened forwardly and closed is attached to the front side of the box-like body. The cover is pivotably supported by a shaft at its lower portion, and attached to a latch portion at its upper portion. If the latch portion is detached from the cover, the cover is pivotably opened about a pivot axis. The case is provided at a back of the cover inside of the large-sized ink-jet recording apparatus, for holding the corresponding one of the ink cartridges. The case has a plurality of door members each of which can be opened and closed and each of which is provided for stabilizing the corresponding one of the ink cartridges that stores a corresponding color ink.

There will be described an outline of procedure of the attachment of the ink cartridge to the ink-jet recording apparatus employing the above-described construction.

The cover attached to the box-like body of the ink-jet recording apparatus is normally closed. Initially, the upper portion of the cover is pushed by the operator such that the latch portion is detached, whereby the cover is pivotably opened. After the cover is opened, there is exposed the case having the plurality of door members each being closed. Then, an upper portion of the door member of the desired ink cartridge is pushed, at a prescribed position, by the operator, whereby the door member is opened. After the door member is opened, a new ink cartridge is attached, and then the door member is closed by the operator. By closing the cover, all procedure of attaching the ink cartridge to the ink-jet recording apparatus is completed.

SUMMARY OF THE INVENTION

In order to replace the ink cartridge, the operator needs to follow the above-described procedure which may be troublesome. Therefore, it is preferable for the operator that replacing the ink cartridge is as easy as possible. If the refill unit for accommodating, holding, and stabilizing the ink cartridge is disposed on the front side of the ink-jet recording apparatus, the ink cartridge is exposed so as to face the operator in the procedure of replacing the ink cartridge because the front side of the ink-jet recording apparatus normally faces the operator. Thus, the procedure of replacing the ink cartridge becomes easier for the operator. Moreover, in order to make the procedure of replacing the ink cartridge easy, it is preferable that the refill unit is constructed in a manner in which the ink cartridge can be smoothly detached and attached without an obstacle being disposed within a movement range of the ink cartridge which is detached and attached.

The above-described large-sized ink-jet recording apparatus disclosed in the Japanese Unexamined Patent Application Publications JP-A-2002-166573 and JP-A-2002-166569 includes the plurality of leg portions for supporting the body thereof, whereby enough space is secured under the cover. Therefore, in the state in which both of the cover and the door member are opened, both of the cover and the door member can be moved away from the movement range of the ink cartridge which is detached and attached. In this state, no obstacle is disposed in the direction in which the ink cartridge is detached and attached, whereby the ink cart ride can be smoothly detached and attached by the operator. Also, in the above-described large-sized ink-jet recording apparatus, it is possible to prevent the ink cartridge from being damaged by its collision with the cover or the door member which could be caused when the ink cartridge is swiftly detached or attached by the operator with great force.

However, if the above-described arrangement disclosed in the Japanese Unexamined Patent Application Publications JP-A-2002-166573 and JP-A-2002-166569 is applied to a small-sized ink-jet recording apparatus, the cover and the door member may become obstacles against the ink cartridge when being detached and attached by the operator since the small-sized ink-jet recording apparatus is generally put on a settling surface such as a top surface of a desk. More specifically, in the small-sized ink-jet recording apparatus employing the above-described arrangement, the cover is brought into contact with the settling surface when being opened by the operator, whereby the cover cannot be moved away from the movement range of the ink cartridge which is detached and attached. Also, the door member cannot be moved away from the movement range of the ink cartridge which is detached and attached.

If the case is disposed on an upper portion of the ink-jet recording apparatus, namely, at a position away from the settling surface on which the ink-jet printer is put such that the cover and the door member can be moved away from the movement range of the ink cartridge which is detached and attached, a height of the ink-jet recording apparatus needs to be taller. Therefore, it is difficult to downsize the ink-jet recording apparatus employing the above-described arrangement disclosed in the Japanese Unexamined Patent Application Publications JP-A-2002-166573 and JP-A-2002-166569.

The present invention has been made in view of the background prior art discussed above. It is therefore an object of the present invention to provide a small-sized ink-jet recording apparatus comprising an ink cartridge holding device which is made in a compact size, which is capable of being equipped with an ink cartridge having a large volume, and which enables an operator to smoothly replace the ink cartridge with a new ink cartridge.

In order to achieve the above-described object, an ink cartridge holding device for holding an ink cartridge according to the present invention includes a holder holding the ink cartridge and having an opening so as to allow the ink cartridge to be inserted thereinto and withdrawn therefrom through the opening, a door which is attached to the holder and is pivotable between (a) an open position at which the opening is uncovered for permitting insertion and withdrawal of the ink cartridge through the opening into and from the holder and (b) a closed position at which the opening is covered for inhibiting the insertion and withdrawal of the ink cartridge through the opening, a locking member which is attached to the door for locking the door at the closed position, and an interference preventing portion which is provided at the door for preventing an interference of the locking member with the withdrawal of the ink cartridge when the door is placed at the open position.

The ink cartridge holding device according to the present invention includes the interference preventing portion for preventing an interference of the locking member with the withdrawal of the ink cartridge when the door is placed at the open position. Therefore, the ink cartridge is smoothly withdrawn from the holder. Further, the ink cartridge is prevented from being damaged by the interference.

BRIEF DESCRIPTION OF THE DRAWINGS

The above and optional objects, features, and advantages of the present invention will be better understood by reading the following detailed description of a preferred embodiment of the invention when considered in conjunction with the accompanying drawings, in which.

DETAILED DESCRIPTION OF THE PREFERRED EMBODIMENT

Figure 1:
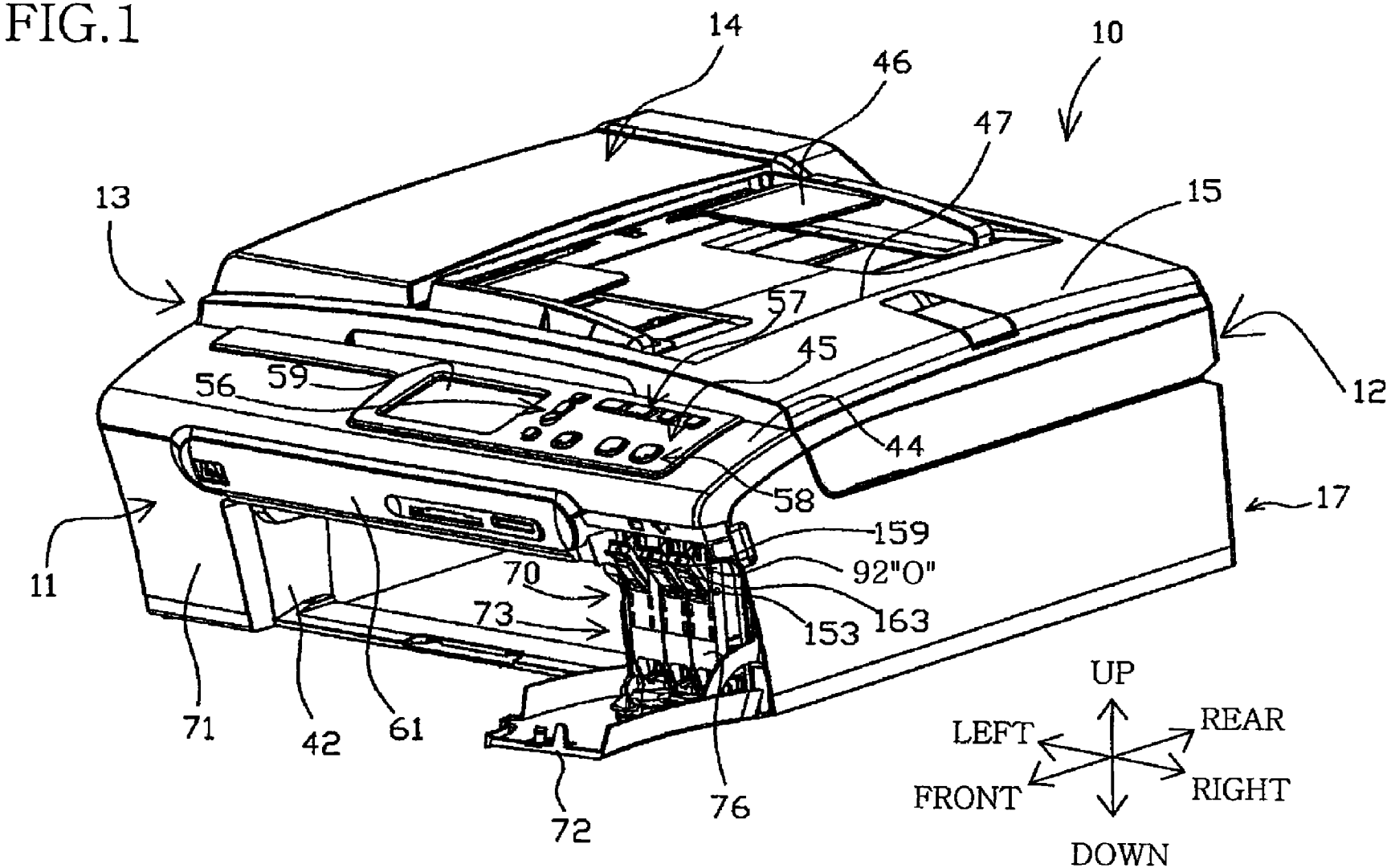
FIG. 1 is a diagonal view showing a Multi Function Device (MFD) as an ink recording apparatus which has an ink cartridge holding device and an ink cartridge holder as an embodiment of the present invention.

Hereinafter, there will be described a preferred embodiment of the present invention by reference to the drawings, FIG. 1 to FIG. 21B. It is to be understood that the present invention is not limited to the details of a present embodiment to be illustrated hereinafter. Further, forward and backward directions, leftward and rightward directions (a horizontal direction), and upward and downward directions (a vertical direction) will be described in the embodiment based on directions indicated in the drawings.

In a Multi Function Device 10 (hereinafter, abbreviated as "MFD 10") which has various functions, e.g., a printing function, a scanning function, a copying function, and a facsimile function, there are integrally provided a printer section 11 located in a lower portion thereof and a scanner section 12 located in an upper portion thereof. The MFD 10 is connected to an external computer, not shown, which transfers an image data or a text data to the MFD 10, and records an image or a text, based on the transferred image data or text data, onto a recording sheet as a recording medium. The recording medium can take any form other than the recording sheet if the image or the text can be recorded thereon, for example, a resin, a cloth, a metal, an optical recording medium, and so on. Further, in the MFD 10, an image can be recorded onto the recording sheet based on an image data outputted from an external apparatus, e.g., a digital camera, if the external apparatus is connected to the MFD 10. In the MFD 10, there is provided a slot section 61, described later. Also, in the MFD 10, an image can be recorded onto the recording sheet based on an image data stored in a data storage medium, e.g., a memory card, if the data storage medium is slot into the slot section 61.

The MFD 10 is characterized in that the above-described printer section 11 functions as an ink-jet recording apparatus, and that a refill unit 70 (which pre-stores ink to be supplied to the recording head that ejects ink droplets onto the recording medium) is provided on the front side of the MFD 10, which is constructed in a compact size, and enables an operator to replace a desired ink cartridge with a new ink cartridge. In the present embodiment, the refill unit 70 is set in the MFD 10. It is to be understood that the MFD 10 may be embodied with various changes and modifications without departing from the substance of the present invention.

Figure 2:
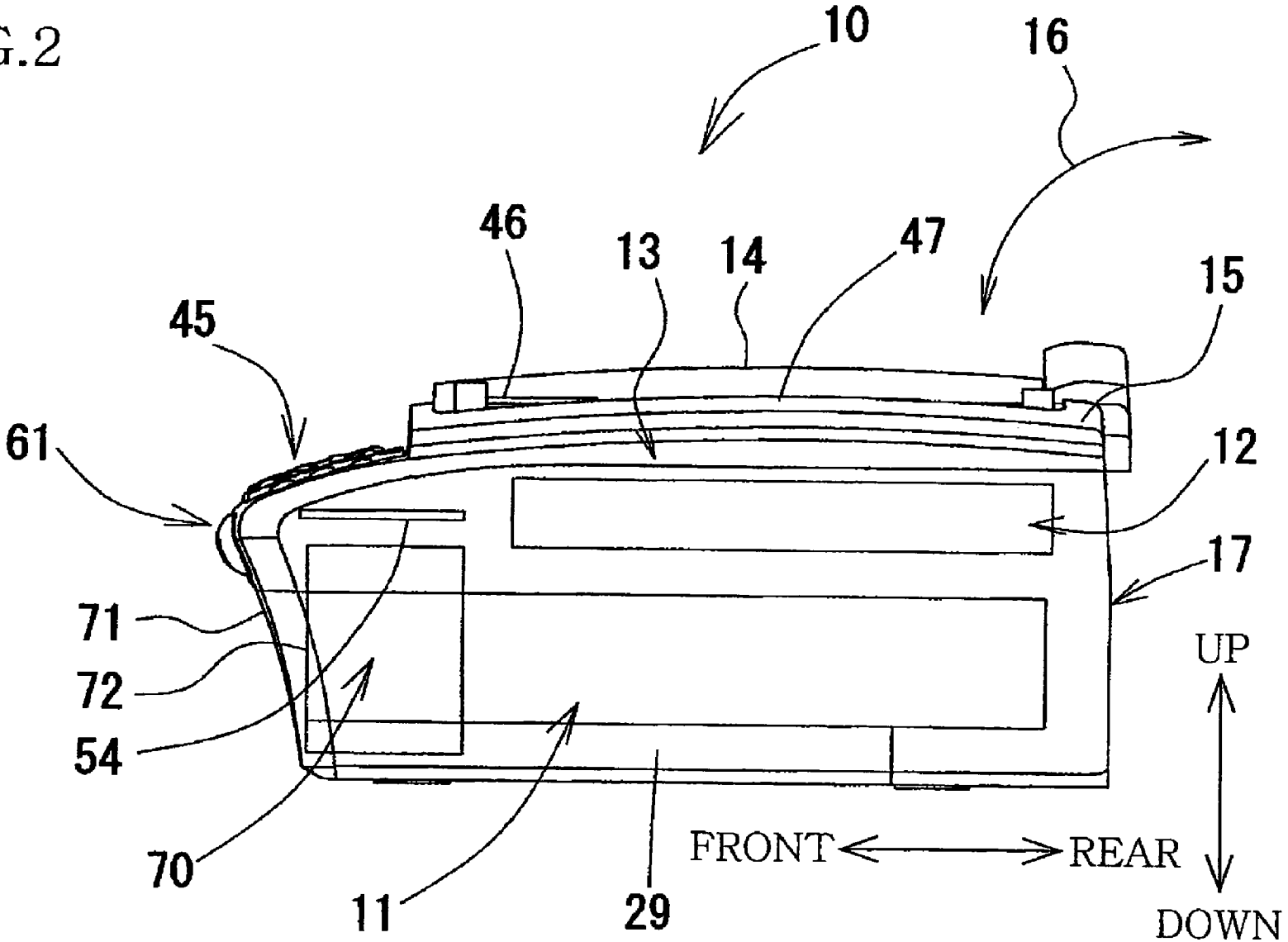
FIG. 2 is a view of the MFD schematically showing an inner constitution thereof.

As shown in FIG. 2, in the MFD 10, the scanner section 12 is located above the printer section 11. In the scanner section 12, there are provided a sheet-mounting portion 13 which functions as a Flatbed Scanner (abbreviated as "FBS") and a cover 15 which is pivotably opened and closed with respect to the sheet-mounting portion 13. The cover 15 is pivotably attached to a rear side of the sheet-mounting portion 13 through a hinge (not shown) so as to be opened and closed. Thus, the cover 15 is opened and closed by being pivoted in a direction indicated by an arrow 16 in FIG. 2. Further, the cover 15 has an Auto Document Feeder 14 (ADF 14) for automatically reading a plurality of original documents. In the present embodiment, the sheet-mounting portion 13 is constructed as a part of a box-like body of the MFD 10, and the cover 15 is constructed as a part of an upper portion of the MFD 10.

Figure 3:
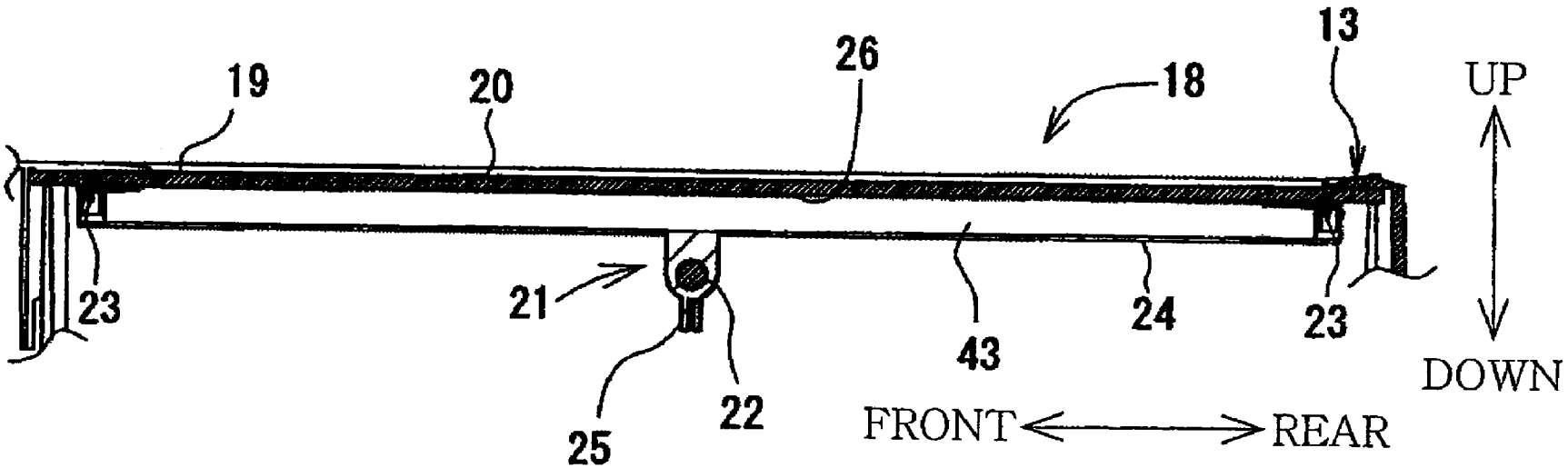
FIG. 3 is a view of the MFD schematically showing an inner constitution of a scanner section thereof.

The sheet-mounting portion 13 also functions as a frame of the scanner section 12. As shown in FIG. 3, a top surface 19 of the sheet-mounting portion 13 is defined by a glass plate 20. Further, an image-reading unit 18 is disposed on an inner space of the sheet-mounting portion 13. An original document is laid on the glass plate 20 so as to be interposed between a lower surface of the cover 15 and an upper surface of the glass plate 20. Then, the image-reading unit 18 is moved along a lower surface of the glass plate 20, namely, moved below the glass plate 20 in the leftward and rightward directions (shown in FIG. 1) so as to read an image from the original document.

The image-reading unit 18 includes a CIS unit 21, a guide rod 22, a pair of roller units 23, 23 and a belt-driving mechanism (not shown). In the present embodiment, the image-reading unit 18 includes a Contact Image Sensor (CIS) which is one of image sensors to be embodied with an unmagnification optical system. However, the image-reading unit 18 may include a Charge Coupled Device (CCD) which is one of image sensors of a contraction optical system, instead of the CIS in the image-reading unit 18.

The CIS unit 21 includes a box-like casing 43 which has an elongated rectangle shape and which is fit in, and supported by, a carriage 24. The guide rod 22 is bridged in a direction perpendicular to plane of FIG. 3, namely, the leftward and rightward directions (i.e., the horizontal direction) in FIG. 1, and penetrates a lower edge portion 25 of the carriage 24. That is, the CIS unit 21 is supported by, and slidable along, the guide rod 22. The belt-driving mechanism includes a timing belt, not shown, which is driven by a motor, for example. The timing belt is connected, at a portion thereof to the lower edge portion 25 of the carriage 24, whereby the carriage 24 is moved together with the timing belt if the belt-driving mechanism is actuated. Accordingly, CIS unit 21 is moved below the glass plate 20.

The pair of roller units 23, 23 is provided on opposite end portions of the CIS unit 21, respectively. The pair of roller units 23, 23 is held in contact with a lower surface 26 of the glass plate 20. When the carriage 24 is moved, each of the pair of roller units 23, 23 is moved with a rolling motion thereof along the lower surface 26 of the glass plate 20*a* in a direction in which the carriage 24 is moved. That is, the pair of roller units 23, 23 is for assisting a smooth movement of the CIS unit 21. Further, each of the respective pair of roller units 23, 23 also functions as a spacer for keeping a constant distance between the CIS unit 21 and the original document laid on the upper surface of the glass plate 20.

As shown in FIG. 1, the cover 15 includes the ADF 14. The ADF 14 is capable of successively carrying the predetermined number of original documents from a sheet tray 47 to a sheet-discharge tray 46. The cover 15 includes a mechanism for successively carrying the original documents. It is noted that a detailed description of the ADF 14 will not be provided since the ADF 14 has a conventional structure. Moreover, the ADF 14 may be omitted from the MFD 10 in the present embodiment.

Figure 4:
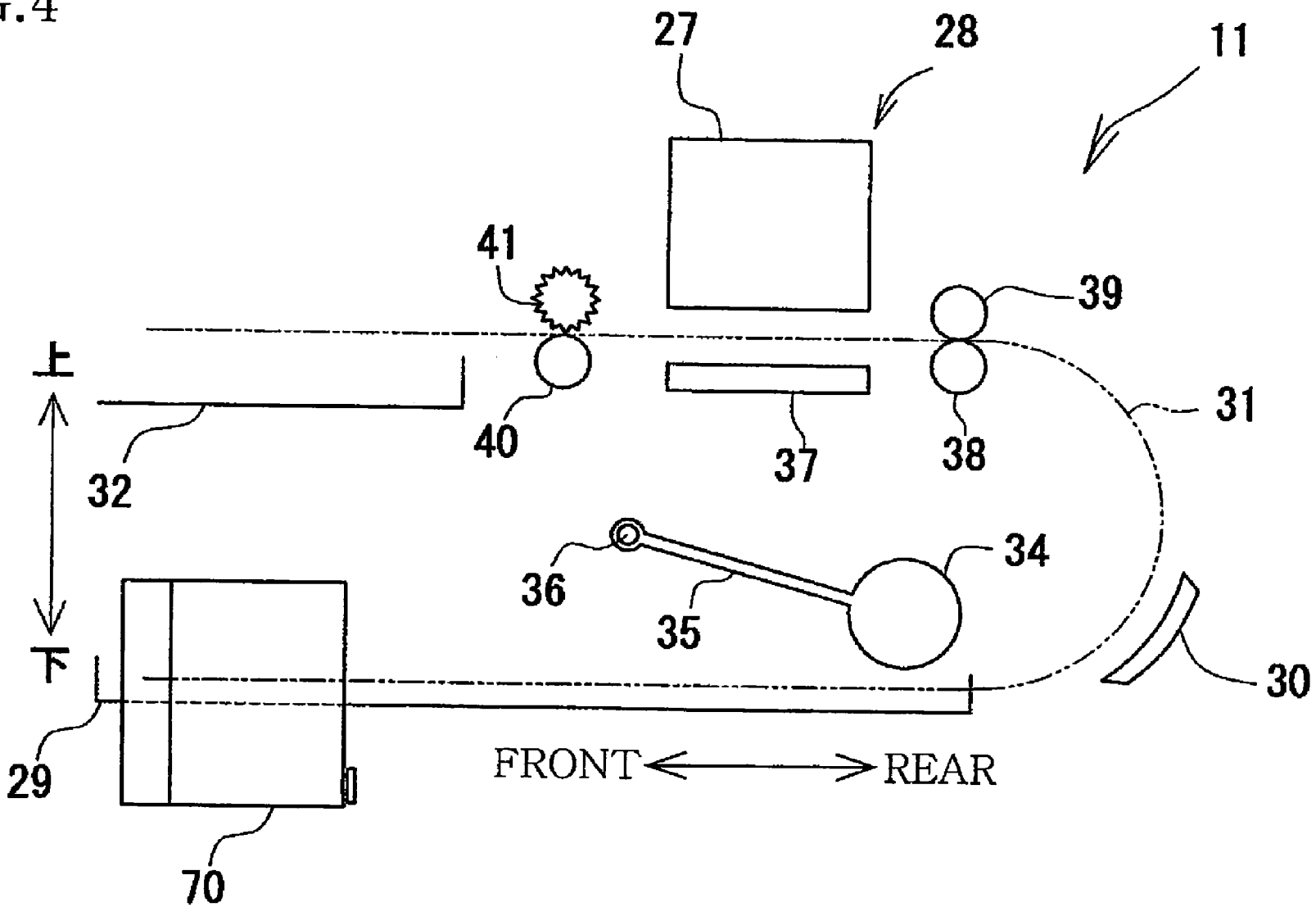
FIG. 4 is a view of the MFD schematically showing an inner constitution of a printer section thereof.

As shown in FIGS. 2 and 4, the printer section 11 includes a frame formed of a lower box-like body 17 and an image-recording portion 28 having an ink-jet recording head 27 (designated just as a "recording head 27"in a following description). In the present embodiment, the printer section 11 is constituted as an ink-jet recording apparatus.

As shown in FIG. 4, the printer section 11 includes the refill unit 70. The refill unit 70 is disposed inside of the lower box-like body 17 at the front side thereof, namely, at a position near to a front face 71 of the lower box-like body 17. In the present embodiment, the refill unit 70 is capable of accommodating four ink cartridges storing mutually different four color inks, i.e., black ink (BK), cyan ink (C), magenta ink (M), and yellow ink (Y). Each of the four color inks is supplied to the recording head 27 via a corresponding ink tube (i.e., an ink supply tube). It is noted that the ink tube is not shown in FIG. 4.

As shown in FIG. 1, the lower box-like body 17 constituting the frame of the printer section 11 includes an opening-closing lid 72 provided on a front side of the lower box-like body 17 so as to define a part of the front face 71 thereof. In a right end portion of the front side of the lower box-like body 17, there is provided an opening 73 which is covered and uncovered by the opening-closing lid 72 functioning as a cover. More specifically, the opening-losing lid 72 is pivoted between the following two postures: (a) an posture in which the opening-closing lid 72 forwardly falls down such that the refill unit 70 is exposed in the opening 73; and (b) a posture in which the opening-closing lid 72 covers the opening 73 such that the refill unit 70 is accommodated in the lower box-like body 17.

Further, in a central portion of the front side of the lower box-like body 17, there is provided an opening 42 inside which a feed tray 29 is disposed (shown in FIG. 4). The feed tray 29 can be attached to, and detached from, an inner portion of the MFD 10 through the opening 42. As shown in FIG. 4, an uppermost one of the stocked recording sheets piled in the feed tray 29 is fed into the MFD 10. Then, as will be stated later on in detail, the image is recorded onto the same sheet. Finally, the recording sheet on which the image is recorded is discharged on a sheet-discharge tray 32 located at a position higher than the feed tray 29.

In the rear side of the MFD 10, at a back of the feed tray 29 (shown in FIG. 4), there is provided an inclined sheet-separate plate 30 for separating an uppermost one of the stocked recording sheets piled in the feed tray 29 and for guiding the same sheet upwardly. A continuous curving space extended upwardly from the inclined sheet-separate plate 30 is defined as a feed path 31. The feed path 31 is initially extended upwardly, and then curved horizontally from the rear side toward the front side of the MFD 10 so as to form a U-turn path as shown in FIG. 4. After curved horizontally, the feed path 31 is still extended so as to pass through the image-recording portion 28 and to eventually reach the sheet-discharge tray 32.

After the uppermost one of the stocked recording sheets piled in the feed tray 29 is fed, the same sheet is carried upwardly in a U-turn manner through the feed path 31, and then passed through the image-recording portion 28 located above the sheet tray 29. In the image-recording portion 28, the image is recorded onto the recording sheet which is carried through the feed path 31. Finally, the recording sheet on which the image has been recorded is discharged to the sheet-discharge tray 32. It is noted that the sheet-discharge tray 32 and the feed tray 29 are not shown in FIG. 1.

As shown in FIG. 4, above the feed tray 29, there is disposed a feed roller 34 for separating the uppermost one of the stocked recording sheets piled in the feed tray 29 and for feeding the same sheet into the feed path 31. In the present embodiment, the feed roller 34 having a conventionally known structure is rotatably supported by a distal end of a feed arm 35 which is moved upwardly and downwardly such that the feed arm 35 can be held in contact with, and away from, the feed tray 29. The feed roller 34 is connected to the motor via a drive transmission mechanism (not shown) that may include a plurality of gears which are meshed with one another. The above-indicated motor is activated so as to generate a driving force. Then, the driving force is transmitted to the feed roller 34, whereby the feed roller 34 is rotated. If the feed roller 34 is rotated, the sheet is fed into the feed path 31.

The feed arm 35 can be pivoted upwardly and downwardly about a proximal-end shaft 36 which pivotably supports the feed arm 35. In a state in which the feed tray 29 is being attached to the MFD 10, the feed arm 35 is biased toward the feed tray 29 by a feed clutch, a spring, and so on (not shown). At a time when the feed tray 29 is attached to and detached from the MFD 10, the feed arm 35 can be moved upwardly. If the feed arm 35 is pivoted downwardly, the feed roller 34 being rotatably supported by the distal end of a feed arm 35 is pressedly brought into contact with an upper surface of the uppermost one of the stocked recording sheets. In this state, the feed roller 34 is rotated, whereby a frictional force is generated between a circumferential surface of the feed roller 34 and the upper surface of the recording sheet. Accordingly, the uppermost one of the stocked recording sheet is fed toward the inclined sheet-separate plate 30, owing to the above-described frictional force.

Then, an edge of the recording sheet is brought into contact with the inclined sheet-separate plate 30 and guided upwardly by the same plate 30 into the feed path 31. There may be a case in which the uppermost recording sheet is fed together with a recording sheet laid just below the uppermost recording sheet by the feed roller 34 due to an act of the frictional force or a static electricity. However, the same sheet laid below the uppermost recording sheet is brought into contact with, and blocked by, the inclined sheet-separate plate 30. Therefore, the recording sheet laid just below the uppermost recording sheet cannot be fed together with the uppermost recording sheet.

The feed path 31 is defined by, except a portion in which the image-recording portion etc., are disposed, an outer guide surface (not shown) and an inner guide surface (not shown) which face each other with a predetermined space interposed therebetween. In the MFD 10, the outer guide surface is provided by a surface of an inner wall of the frame of the printer section 11 which is constituted by the lower box-like body 17. The inner guide surface is defined by a surface of a guide member which is provided in the frame of the printer section 11. Further, especially at a curved portion of the feed path 31, there may be provided a conveyance roller (not shown) which can be rotated about a rotation axis extending in a widthwise direction of the feed path 31, namely, a direction perpendicular to a plane of FIG. 4, such that a circumferential surface of the conveyance roller is exposed in the outer guide surface or the inner guide surface of the feed path 31. If the conveyance roller is provided, the recording sheet is brought into contact with the guide surfaces of the feed path 31 even at the curved portion thereof such that the same sheet can be smoothly carried.

The image-recording portion 28 is provided in a downstream side of a portion of the feed path 31 which is U-turned upwardly in a sheet-discharge direction. In the image-recording portion 28, there is provided a platen 37 in which an upper surface thereof faces a lower surface of the recording head 27. As the recording sheet is carried above the platen 37, the recording head 27 ejects the ink droplets onto the recording sheet. The recording head 27 is mounted on the carriage, not shown, which is reciprocated by a CR motor (carriage motor) in a direction perpendicular to the plane of FIG. 4. A position and a reciprocating motion of the recording head 27 are detected by a carriage encoder, not shown. The recording head 27 selectively ejects the ink droplets of the four color inks onto the recording sheet while reciprocating, whereby the image is recorded on the recording sheet.

In an upstream side of a portion of the feed path 31 in which the recording head 27 is located, in the sheet-discharge direction, there are provided a drive roller 39 and a presser roller 38. The drive roller 39 is rotatably driven by a Line Feed motor (LF motor), not shown. The drive roller 39 and the presser roller 38 nip the recording sheet therebetween such that the same sheet is to be fed in the feed path 31. Owing to the drive roller 39 being rotated by the above-described LF motor, the recording sheet is then carried downstream in the feed path 31 in the sheet-discharge direction. Accordingly, the recording sheet is carried above the platen 37.

In a downstream side of the portion of the feed path 31 in which the recording head 27 is located, in the sheet-discharge direction, there are provided a sheet-discharge roller 40 and a presser roller 41. The sheet-discharge roller 40 is rotatably driven by the LF motor which also drives the drive roller 39. In other words, the sheet-discharge roller 40 and the drive roller 39 are synchronously driven by the LF motor via an inter-lock mechanism, not shown. The sheet-discharge roller 40 and the presser roller 41 nip the recording sheet onto which the ink droplets have been ejected such that the same sheet is interposed therebetween. Owing to the sheet-discharge roller 40 being rotated by the above-described LF motor, the recording sheet is then carried downstream in the feed path 31 in the sheet-discharge direction.

The presser roller 38 is elastically biased toward the drive roller 39 such that the presser roller 38 presses the drive roller 39 with a predetermined pressing force. Therefore, when the recording sheet is interposed between the rollers 38 and 39, the presser roller 38 is elastically moved downwardly by a thickness of the recording sheet, and at the same time, cooperatively nips the same sheet with the drive roller 39. In this arrangement, the recording sheet is nipped by the drive roller 39 and the presser roller 38, whereby the rotating force of the drive roller 39 is reliably transmitted to the recording sheet. Also, the presser roller 41 is provided with respect to the sheet-discharge roller 40 in a same manner as the presser roller 38. It is noted that, in the present embodiment, a peripheral portion of the presser roller 41 has a spur shape in order to maintain high quality of the image recorded on the recording sheet since the presser roller 41 is pressedly held in contact with a recorded surface of the recording sheet.

The recording sheet nipped by the drive roller 39 and the presser roller 38 is intermittently carried on the platen 37 by predetermined line feed pitch. The recording head 27 is moved back and forth per a line feed, and in turn records the image on the recording sheet from a leading portion thereof toward a trailing portion thereof. The recording sheet on which the image is recorded is nipped, from its leading portion, by the sheet-discharge roller 40 and the presser roller 41. That is, while the recording sheet is intermittently carried at the predetermined line feed pitch in the state in which the same sheet is nipped, at its leading portion, by the sheet-discharge roller 40 and the presser roller 41, and also nipped, at the trailing portion, by the drive roller 39 and the presser roller 38, the image is recorded on the same sheet by the recording head 27. After the image is recorded on a predetermined recording area of the recording sheet, the sheet-discharge roller 40 is continuously rotated so that the same sheet being nipped by the sheet-discharge roller 40 and the presser roller 41 is discharged onto the sheet-discharge tray 32.

As shown in FIG. 1, a control panel 45 is attached to an upper inclined surface of the lower box-like body 17 which constitutes the frame of the printer section 11. The control panel 45 is provided such that the operator operates the printer section 11 and the scanner section 12, and so on. On an upper surface 44 of the control panel 45, there are provided various operation keys 56, 57, 58 and a liquid crystal display 59, etc.

As shown in FIG. 2, below the control panel 45, namely, inside of the lower box-like body 17, there is provided a control board 54 which constitutes as a control portion. The operation keys 56, 57, 58 provided on the control panel 45 are connected, via a flat cable (not shown), to the control board 54. The control portion which includes the control board 54 processes commands from each of the operation keys 56, 57, 58 and controls an operation of the MFD 10.

The operator inputs a desired command by pushing the respective operation keys 56, 57, 58 in order to operate the MFD 10. The MFD 10 follows the inputted command, thereby performing a predetermined operation. As described above, the MFD 10 may be connected to the personal computer and so on. In this case, the MFD 10 is allowed to perform the predetermined operation by following commands transmitted from the personal computer via a scanner driver, a printer driver, and so on, other than the command inputted by the operator from the control panel 45.

As shown in FIG. 1, on the front surface of the MFD 10, there is provided the slot section 61 to which the data storage medium, e.g., the compact memory card, can be slot. The compact memory card is capable of storing various data including the image data. If the image data is stored in the compact memory card, the image data is read from the compact memory card loaded into the slot section 61. Then, information relating to the image data, such as the image itself, a size of the image, a form of the image, a creation date of the image, etc., is displayed on the liquid crystal display 59. Next, a desired image displayed on the liquid crystal display 59 is recorded onto the recording sheet in the printer section 11. The command for recording the image onto the recording sheet is inputted from the control panel 45.

Next, there will be described a structure of the refill unit 70 of the present embodiment The refill unit 70 corresponds to the ink cartridge holding device according to the present invention.

The refill unit 70 includes a unit body 74 which is capable of accommodating and firmly holding a plurality of ink cartridges 63. The unit body 74 includes: a case 75, i.e., an ink cartridge holder (abbreviated as "a holder"), to which the plurality of ink cartridges 63 is attached and from which the plurality of ink cartridges 63 is detached; a door unit 76 which is provided on the case 75; and a pair of drawer portions 77, 77 which are provided on the door unit 76, as shown in FIGS. 5 and 6.

Figure 5:
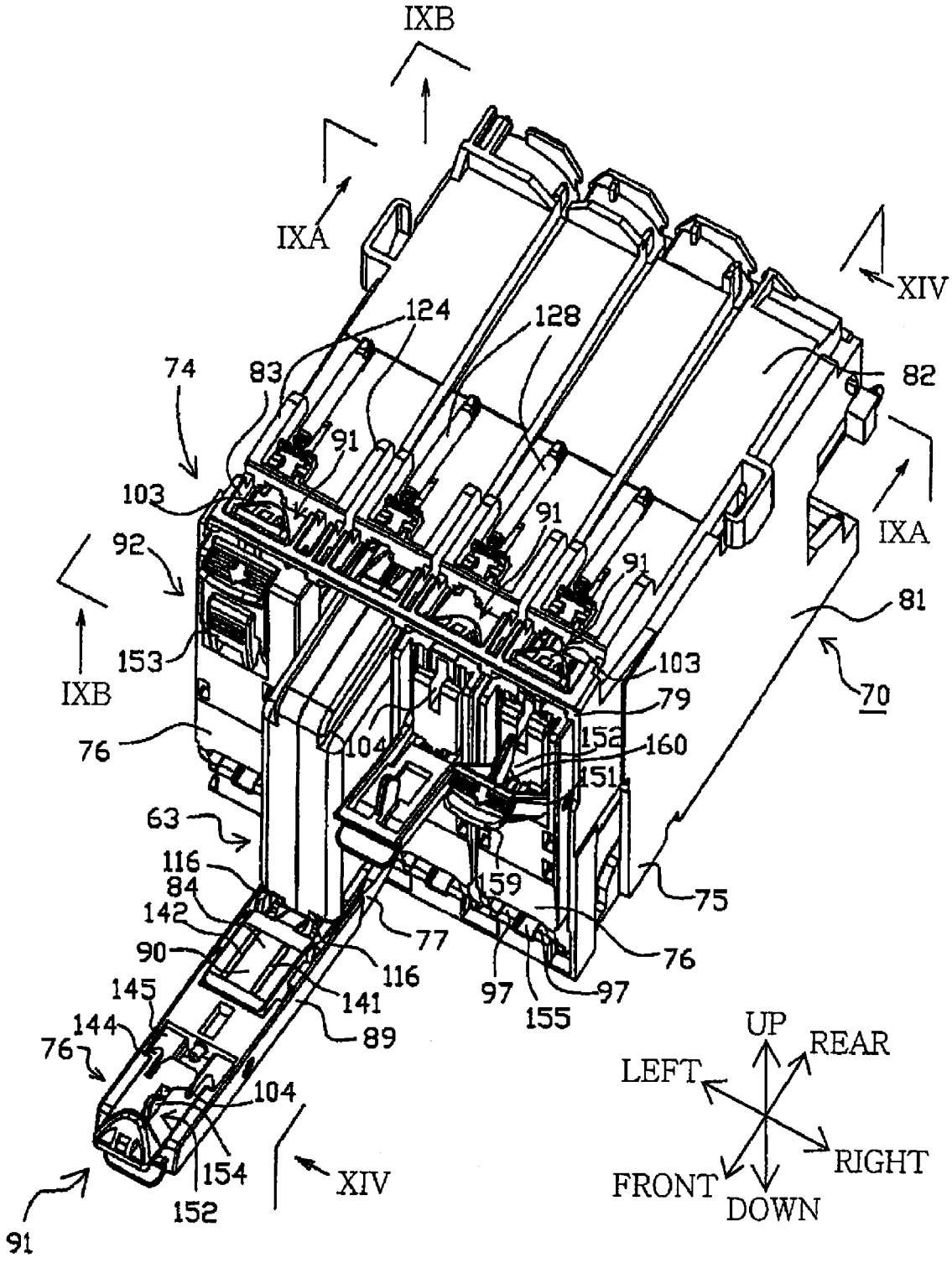
FIG. 5 is a diagonal view of a refill unit of the MFD as the ink cartridge holding device.
Figure 6:
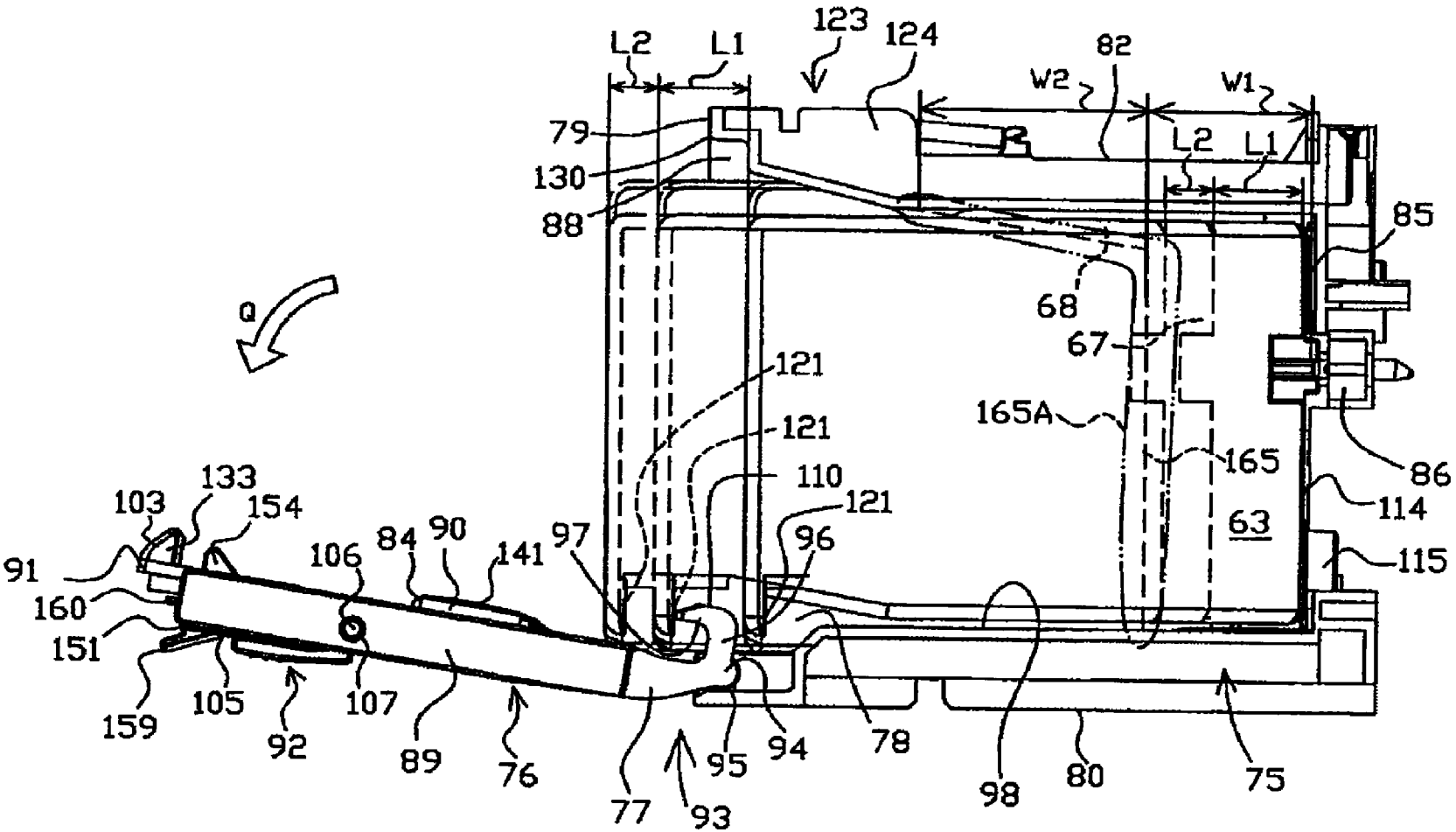
FIG. 6 is a cross-sectional view of an opening-closing lid and the refill unit of the MFD.
Figure 8:
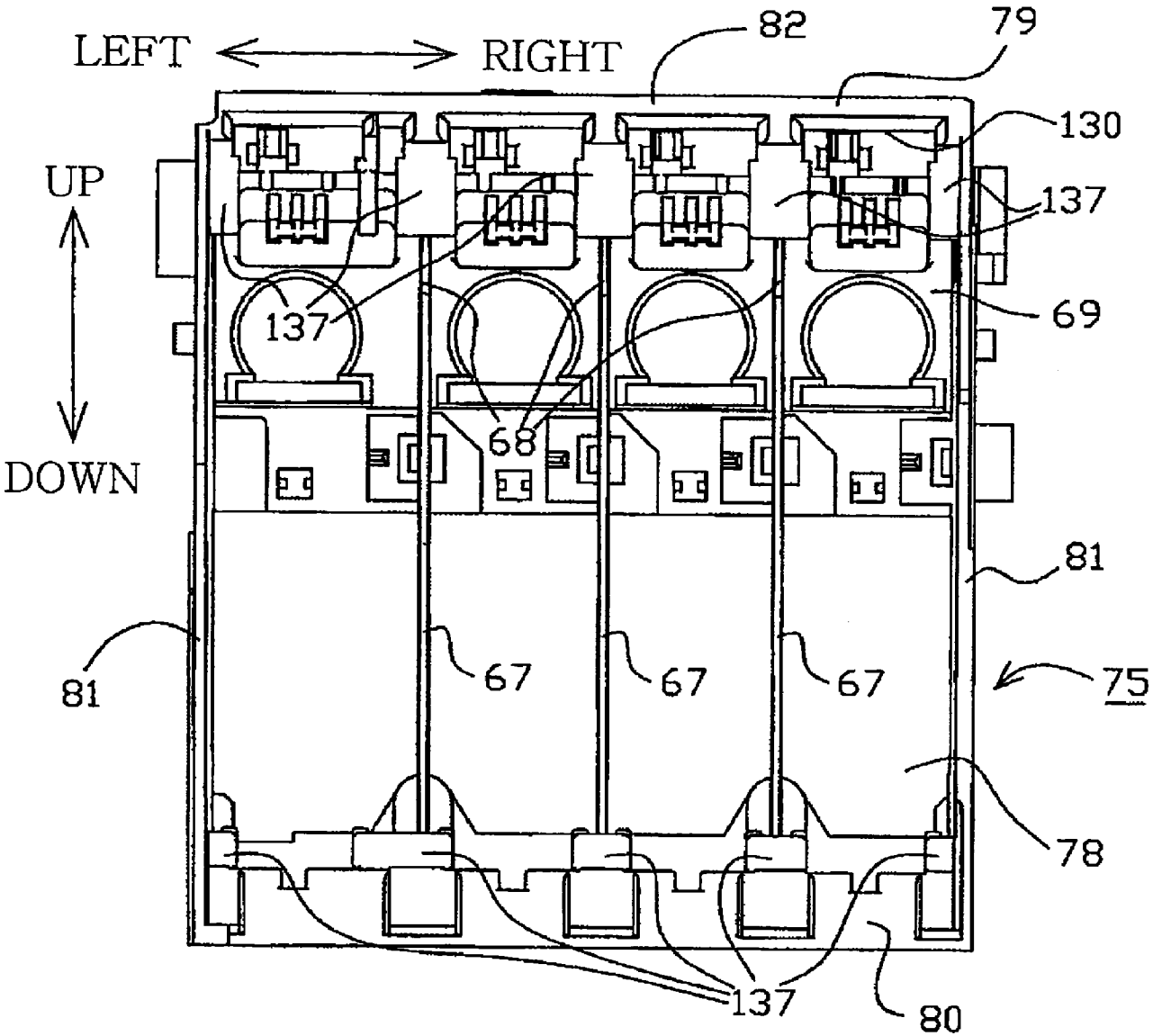
FIG. 8 is a front view of a case of the refill unit as the ink cartridge holder.

The case 75 having a generally rectangular parallelpiped shape as a whole includes: a bottom wall portion 80; a pair of side plate portions 81, 81 which stand upwardly at right and left end portions of the bottom wall portion 80, respectively, so as to face each other; and a top wall portion 82 which bridges over the pair of side wall portions 81, 81, as shown in FIGS. 5, 6, and 8. The bottom wall portion 80, the pair of side wall portions 81, 81, and the top wall portion 82 constitute a peripheral wall portion. Inside of the case 75, there are provided a plurality of accommodations 78 each of which has a cell structure and each of which accommodates a corresponding one of the plurality of the ink cartridges 63. In the present embodiment, the case 75 has four accommodations 78. Each of the ink cartridges 63 can be attached to, and detached from, a corresponding one of the accommodations 78. The plurality of ink cartridges 63 store mutually different four color inks, respectively, i.e., a black ink, a yellow ink, a magenta ink, and a cyan ink. A configuration constituted by inner surfaces of each of the accommodation 78 corresponds to a configuration constituted by outer circumference surfaces of the corresponding one of the ink cartridges 63. Therefore, each of the ink cartridges 63 is firmly and reliably held by the corresponding one of the accommodations 78, so as not to have a large amount of play relative to the corresponding accommodation 78. It is noted that each of the accommodations 78 functions as the holder for holding a corresponding one of the plurality of ink cartridges 63.

As shown in FIG. 6, a plurality of openings 88 are provided in a front face 79 of the case 75. Each of the openings 88 corresponds to a corresponding one of the accommodations 78. That is, in the case 75, each of the openings 88 communicates with the corresponding one of the accommodations 78. Each of four ink cartridges 63 is attached to, and detached from, the corresponding one of the accommodations 78 via the corresponding one of the openings 88 from a side of the front face 79 of the case 75. It is considered that the case 75 has one opening in which the openings 88 join to each other.

Figure 11:
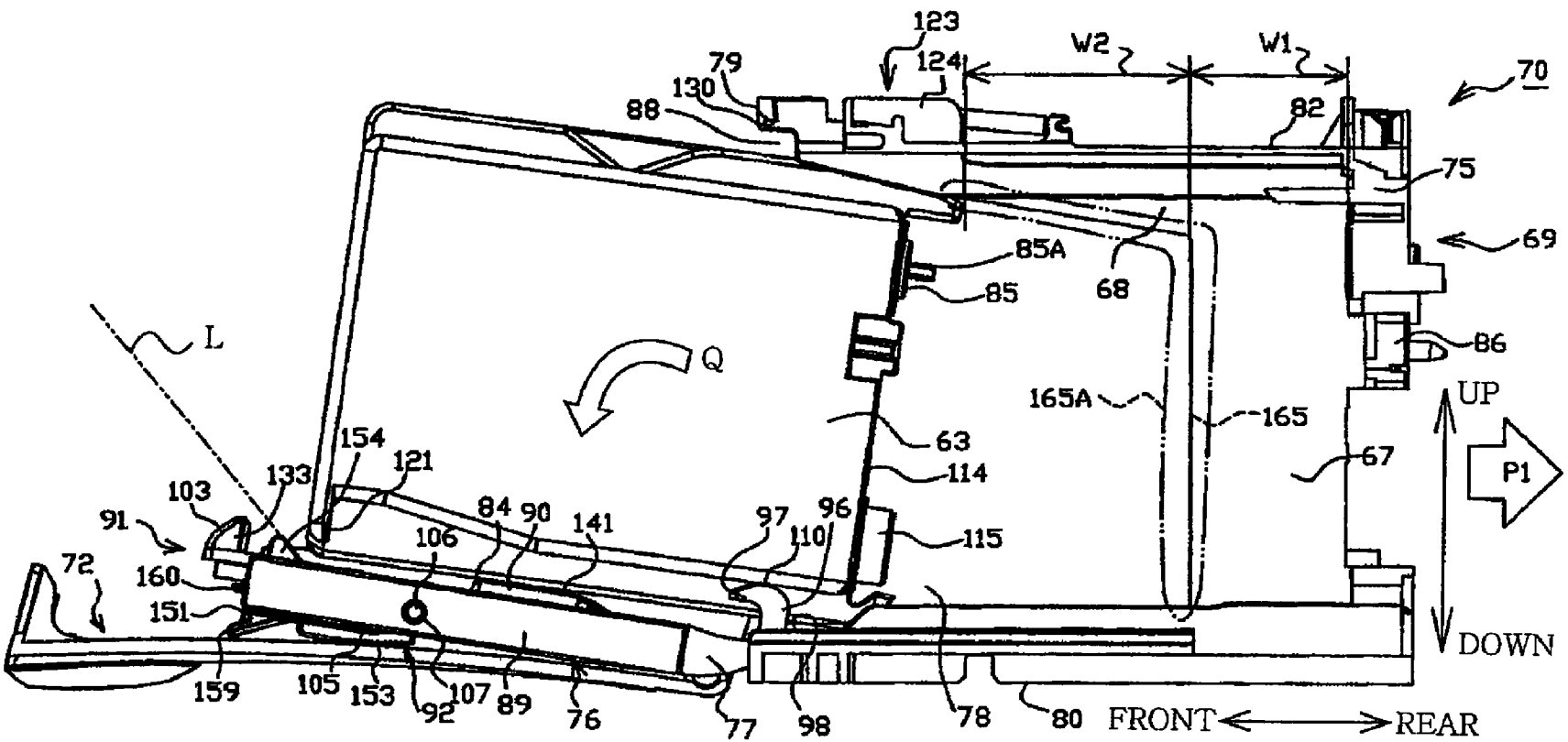
FIG. 11 is a cross-sectional view of the body of the refill unit.
Figure 14:
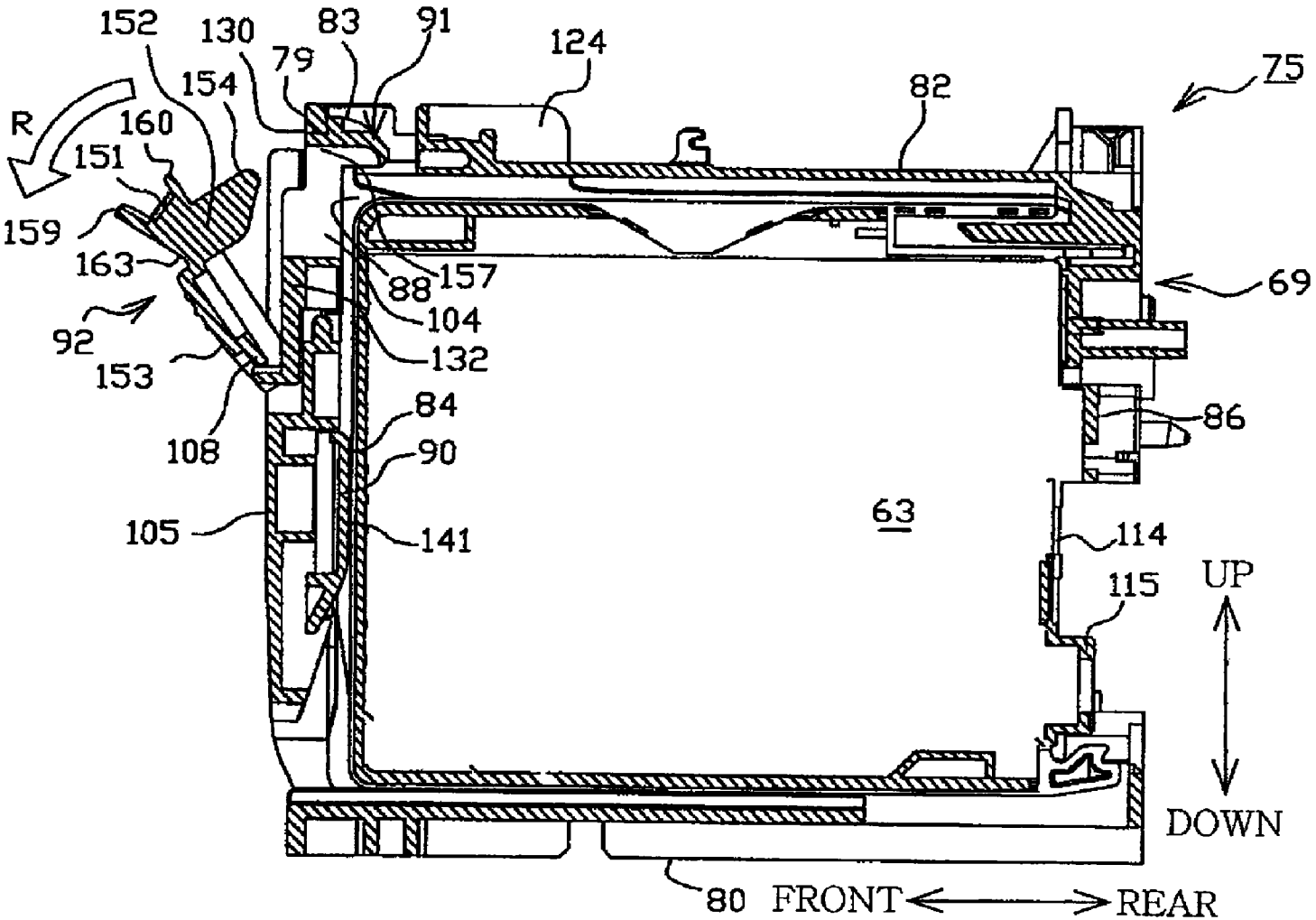
FIG. 14 is a cross-sectional view taken along a line XIV-XIV indicated in FIG. 5.
Figure 19:
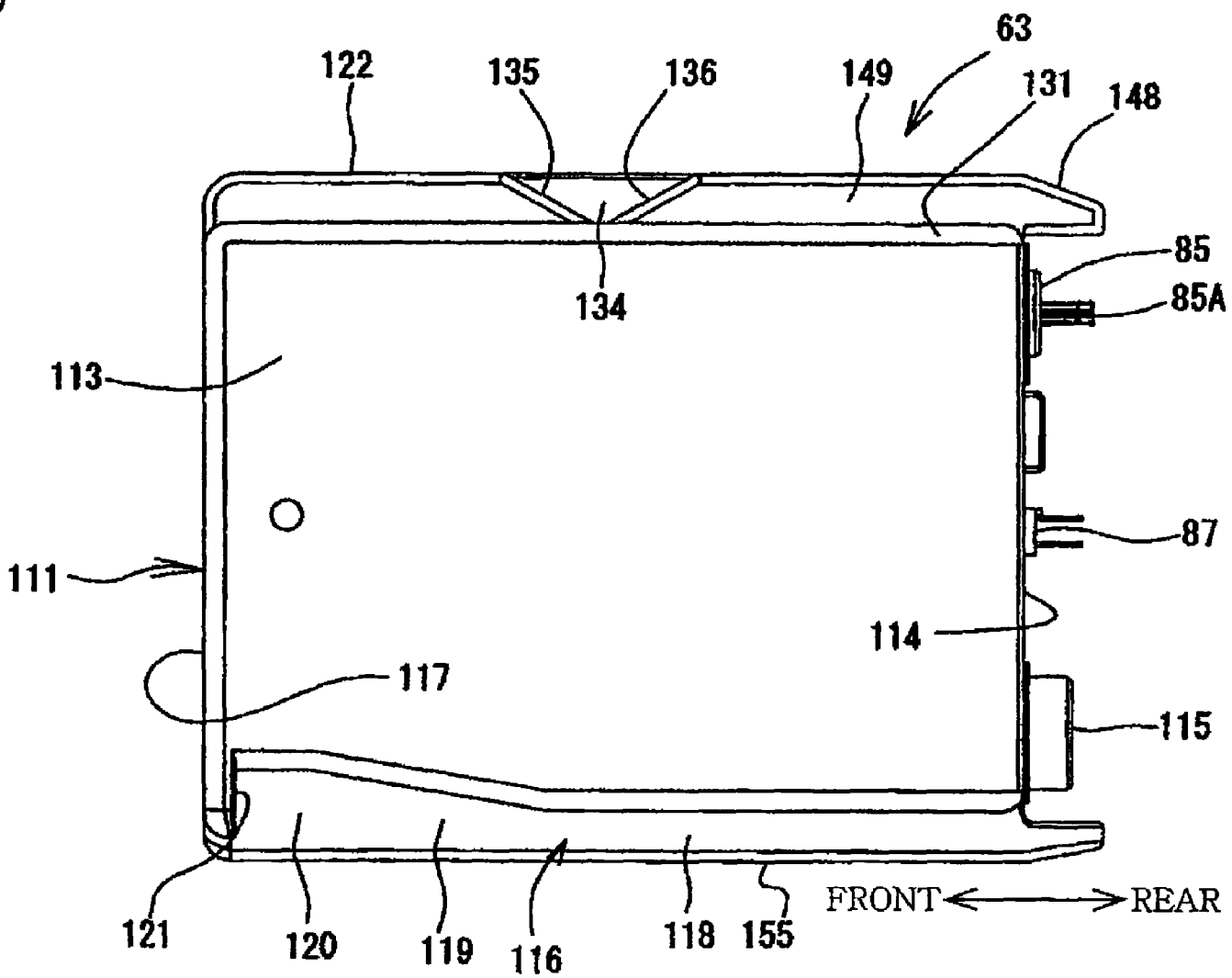
FIG. 19 is a side view of an ink cartridge.
Figure 20:
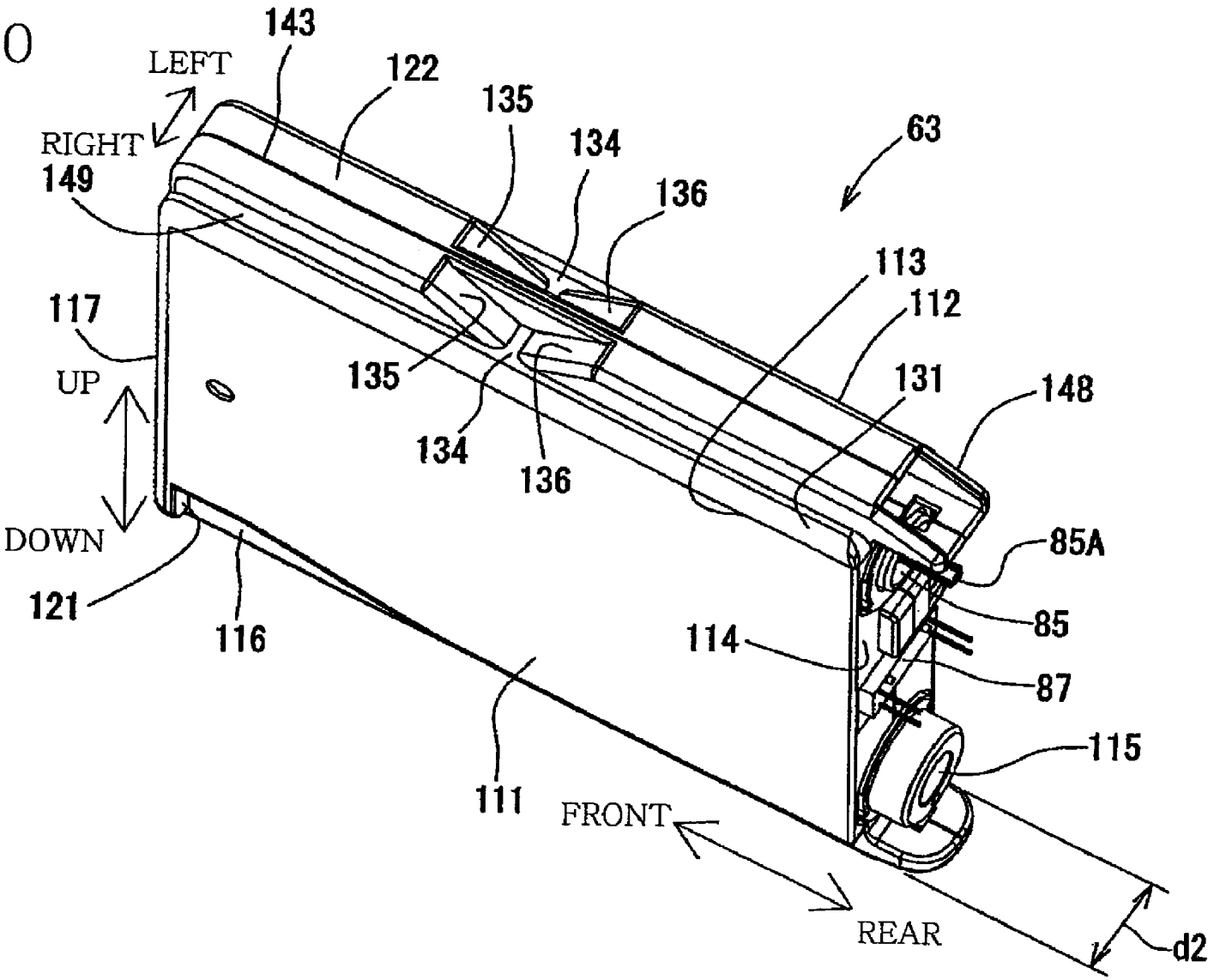
FIG. 20 is a diagonal view of the ink cartridge.

Further, on a rear wall portion 69 (an end wall portion) of the case 75, there is provided a plurality of connecters 86 for liquid level detectors 87, as shown in FIGS. 6, 11 and 14. Each of the liquid level detectors 87 is connected to a corresponding one of the connecters 86, as shown in FIGS. 19 and 20. If the ink cartridge 63 is accommodated in a corresponding one of the accommodations 78, a corresponding one of the liquid level detectors 87 is fitted into a liquid-level detecting portion provided on a corresponding one of the ink cartridges 63 such that a liquid consumption level of the ink stored in the corresponding one of the ink cartridges 63 is detectable. In FIGS. 19 and 20, the state that one of the liquid level detectors 87 is fitted into the corresponding one of the ink cartridge 63 is shown. Indeed, each of the liquid level detectors 87 is connected to a corresponding one of the connectors 86 and fixed to the rear wall portion 69 of the case 75. Each of the connectors 86 is connected to the above-described control portion which always observes the liquid consumption level of the ink stored in each of the ink cartridges 63.

As shown in FIG. 6, an upper surface of the bottom wall portion 80 constitutes a placing surface 98 on which each of the ink cartridges 63 is placed. A height level of the placing surface 98 is determined such that each of later-described push rods 85A opens a corresponding one of air-introducing valves 85 each provided in a corresponding one of the ink cartridges 63 in the state in which the corresponding ink cartridge 63 is attached to a corresponding one of the respective accommodations 78, such that a corresponding one of ink supply pipes (i.e., ink supply needle, not shown) is inserted into a corresponding one of ink supply valves 115 (each as an ink extracting portion) of the respective ink cartridges 63, and such that the liquid level detectors 87 can be fitted in the respective liquid-level detecting portions of the respective ink cartridges 63, as shown in FIGS. 19 and 20.

As shown in FIG. 6, the top wall portion 82 has ribs 124 each of which uprightly extends and each of which helps to increase a rigidity of the case 75. Further, on the top wall portion 82, there are provided later-described swing arms 123.

Hereinafter, there will be described an inner structure of the case 75 by reference to FIGS. 6, 8, and 9.

The case 75 is made of a synthetic resin composition such as an ABS resin, an acrylic resin (Methyl-Meta-Acrylate), a polypropylene (PP), and a poly-carbonate (PC), and molded by using a die assembly. For instance, an injection molding is generally applied as the die assembly molding, but other molding method may be applied to the case 75 as well. Further, the die assembly is generally made of a metal. However, the die assembly may be replaced with a die assembly made of a glass, a resin, a ceramic, and so on only if the replaced die assembly can be suitably adapted to the molding of the case 75.

In the molding using the die assembly, the case 75 is formed with predetermined draft (predetermined degree of taper or slope) for facilitating removal of the case 75 from the die assembly. In the present embodiment, the case 75 is molded such that a parting line is located in the vicinity of a rear edge of the case 75 (as seen in FIGS. 9A and 11). The case 75 is moved relative to the die assembly in the backward direction (i.e., a direction indicated by an arrow "P1" in FIGS. 9A and 11), so as to be removed from the die assembly. Therefore, the above-described draft is provided by a slight inclination of side surfaces of the case 75, which are inclined by a predetermined angle $\phi$ of approximately ½°-2°, such that each wall portion of the case 75 has a thickness that is reduced as viewed from the rear side toward the front side as seen in FIGS. 9A and 11.

Figure 9B:
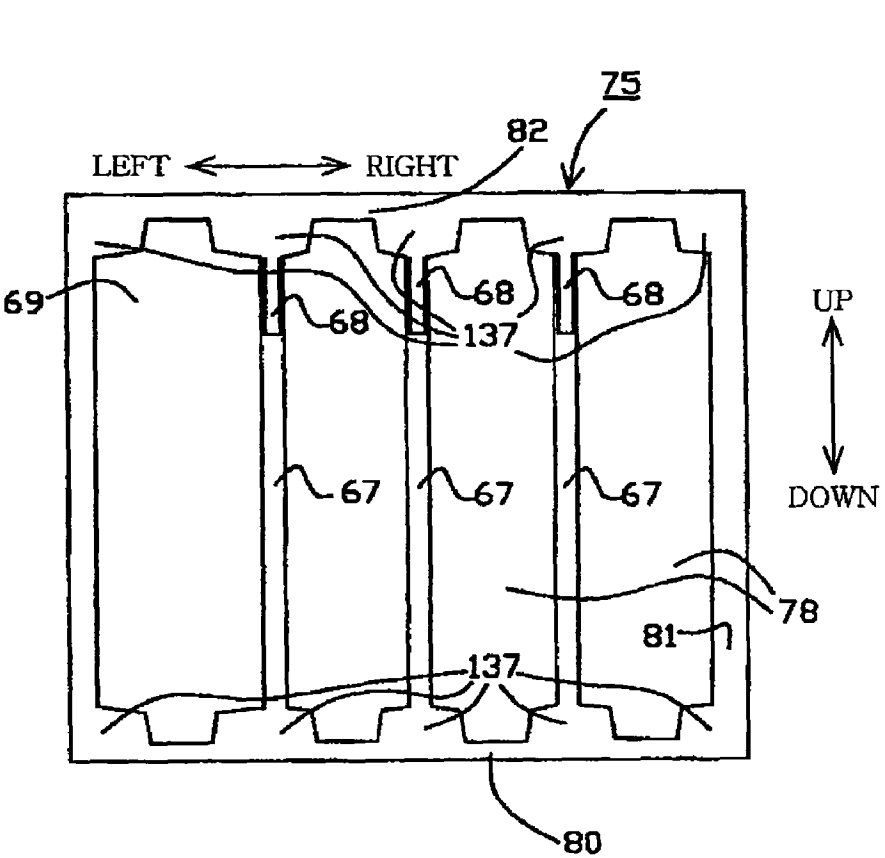
FIG. 9B is a cross-sectional view taken along a line IXB-IXB indicated in FIG. 5.
Figure 9A:
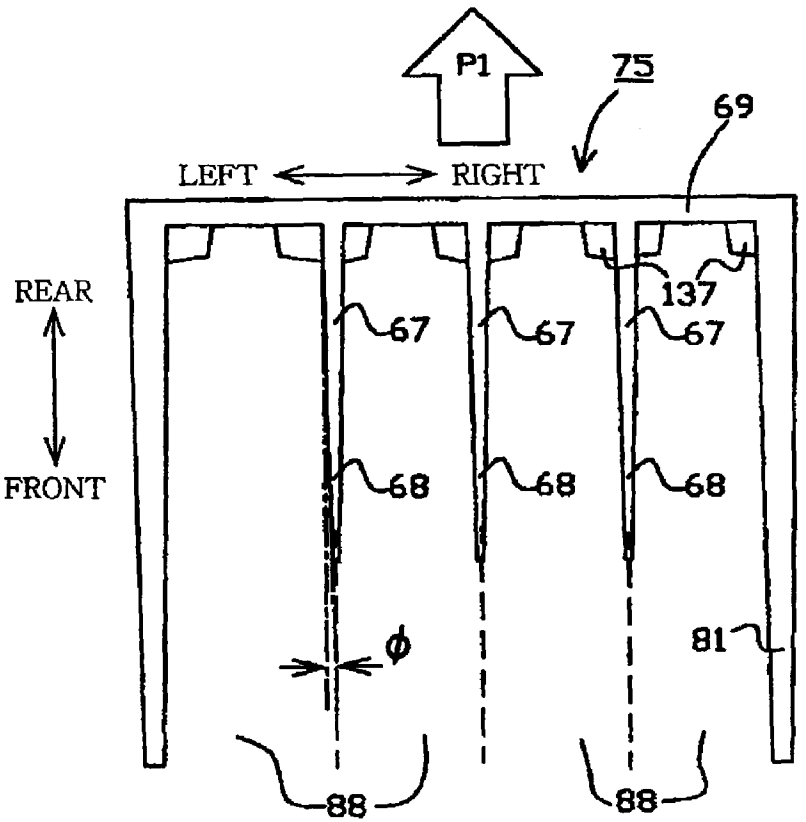
FIG. 9A is a cross-sectional view taken along a line IXA-IXA indicated in FIG. 5.

As described above, the case 75 includes: the bottom wall portion 80; the pair of side wall portions 81, 81 each of which stands upwardly at the right and left edge portions of the bottom wall portion 80, respectively, so as to face each other; and the top wall portion 82 which bridges over the pair of side wall portions 81, 81, as shown in FIGS. 8 and 9B. Further, inside of the case 75, there is provided a plurality of partition wall portions 67 for dividing the inner space of the case 75 into the four accommodations 78.

Figure 7A:
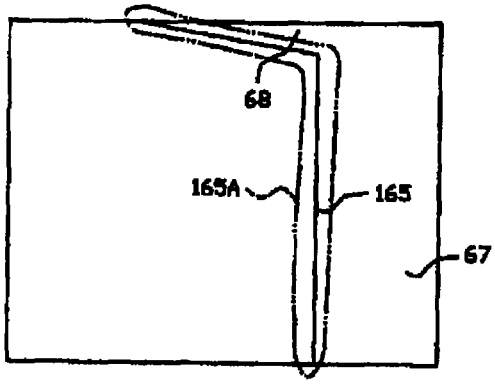
FIG. 7A is a view schematically showing a shape of a partition wall as one of various examples which is applicable to the ink cartridge holder.

Each of the partition wall portions 67 has, as shown in FIG. 7A, substantially rectangular plate-like shape as viewed from the side of the case 75 (as viewed in the horizontal direction in FIGS. 8, 9A, and 9B). A number of the partition wall portions 67 correspond to a number of the ink cartridges 63 accommodated in the case 75. As shown in FIGS. 9A and 9B, each of the partition wall portions 67 is disposed so as to join to the bottom wall portion 80 and the top wall portion 82 of the case 75, and so as to extend from the rear wall portion 69 of the case 75 to which a proximal end thereof joins, in a direction toward the corresponding openings 88. In other words, each of the partition wall portions 67 interconnects two portions of the peripheral wall portion. The partition wall portions 67 are substantially parallel to the pair of side wall portions 81, 81. Further, each of the partition wall portions 67 has a guide wall portion 68 (an extension wall portion) which is adjacent to the top wall portion 82, which extends from corresponding one of the partition walls 67 toward the corresponding opening 88, as shown in FIGS. 8, 9A, and 9B, and which has a tapered shape having a width thereof that is reduced in a direction toward the opening 88. Further, the guide wall portion 68 has a distal end thereof that reaches the corresponding opening 88. Upper guide rail portions 137 are provided in respective corners defined by intersections of the top wall portion 82 and the partition wall portions 67. Similarly, lower guide rail portions 137 are provided in respective corners defined by intersections of the bottom wall portion 80 and the partition wall portions 67. Each of the upper and lower guide rail portions 137 extends from the rear wall portion 69 of the case 75 toward the openings 88. The bottom wall portion 80, the pair of side wall portions 81, 81, the top wall portion 82, the guide rail portions 137, 137, the guide wall portions 68, and the partition wall portions 67 are integrally formed by the injection molding.

As shown in FIG. 9A, since there is provided a draft having a predetermined angle $\phi$ of, for example, approximately 1° in each of the partition wall portions 67 and each of the guide wall portions 68 with respect to a direction in which the case 75 is drafted from the die assembly (i.e., to the direction indicated by the arrow "P1" in FIG. 9A), thickness of each of the partition wall portions 67 in the right and left direction and thickness of each of the guide wall portions 68 in the right and left direction (as shown in FIG. 9A) gradually become thinner as getting close to the front side than to the rear side. Each of distal ends 165 of the corresponding partition wall 67 is provided on a position that is distant from the corresponding proximal end of the corresponding partition wall portion 67, i.e., the rear wall portion 69 of the case 75, by predetermined distance, "W1", toward the corresponding opening 88. There will be more specifically described effects of the above-described arrangement later.

Figure 10:
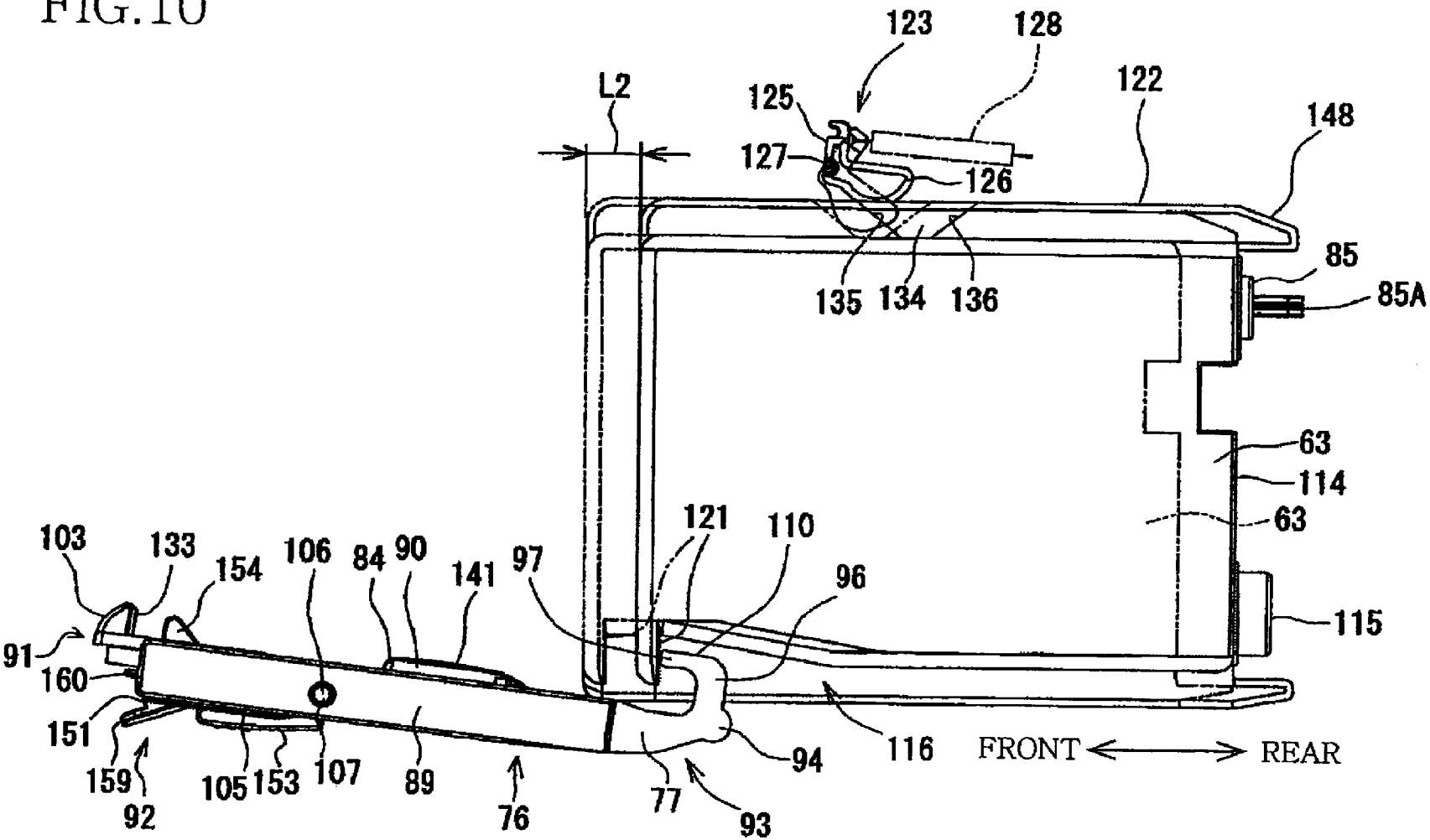
FIG. 10 is a side view of a body of the refill unit.

FIG. 10 is the side view of the body of the refill unit 74. FIG. 10 schematically shows a relationship between an opening-closing movement of the door unit 76 and a swing movement of the swing arm 123. The swing arm 123 is, as described above, provided on the top plate potion 82, as shown in FIG. 10.

As shown in FIG. 10, the swing arm 123 has a substantially L-shape as a whole and includes a first arm 125 and a second arm 126. On a boundary portion between the first arm 125 and the second arm 126, there is provided a support shaft 127 which is rotatably supported by the top wall portion 82 such that the swing arm 123 is pivotable relative to the top wall portion 82. Between the first arm 125 and the top wall portion 82, a tension spring 128 is attached Owing to the tension spring 128, the swing arm 123 is elastically biased so as to be always pivoted clockwise, namely, be in a posture indicated by a chain double-dashed line in FIG. 10. Since the swing arm 123 is biased in above-described arrangement, the swing arm 123 can be displaced in the posture indicated by a solid line in FIG. 10 by receiving a counter clockwise force which resists an elastic force of the tension spring 128. As described later, the swing arm 123 can be engaged with one of front inclined surfaces 135, 135 of a corresponding one of a pair of concave portions 134, 134 provided on an upper side of the ink cartridge 63. Therefore, where the swing arm 123 is engaged with said one of the front inclined surfaces 135, 135, the swing arm 123 biases the ink cartridge 63 in a direction in which the ink cartridge 63 is pushed out from the accommodation 78.

Figure 12:
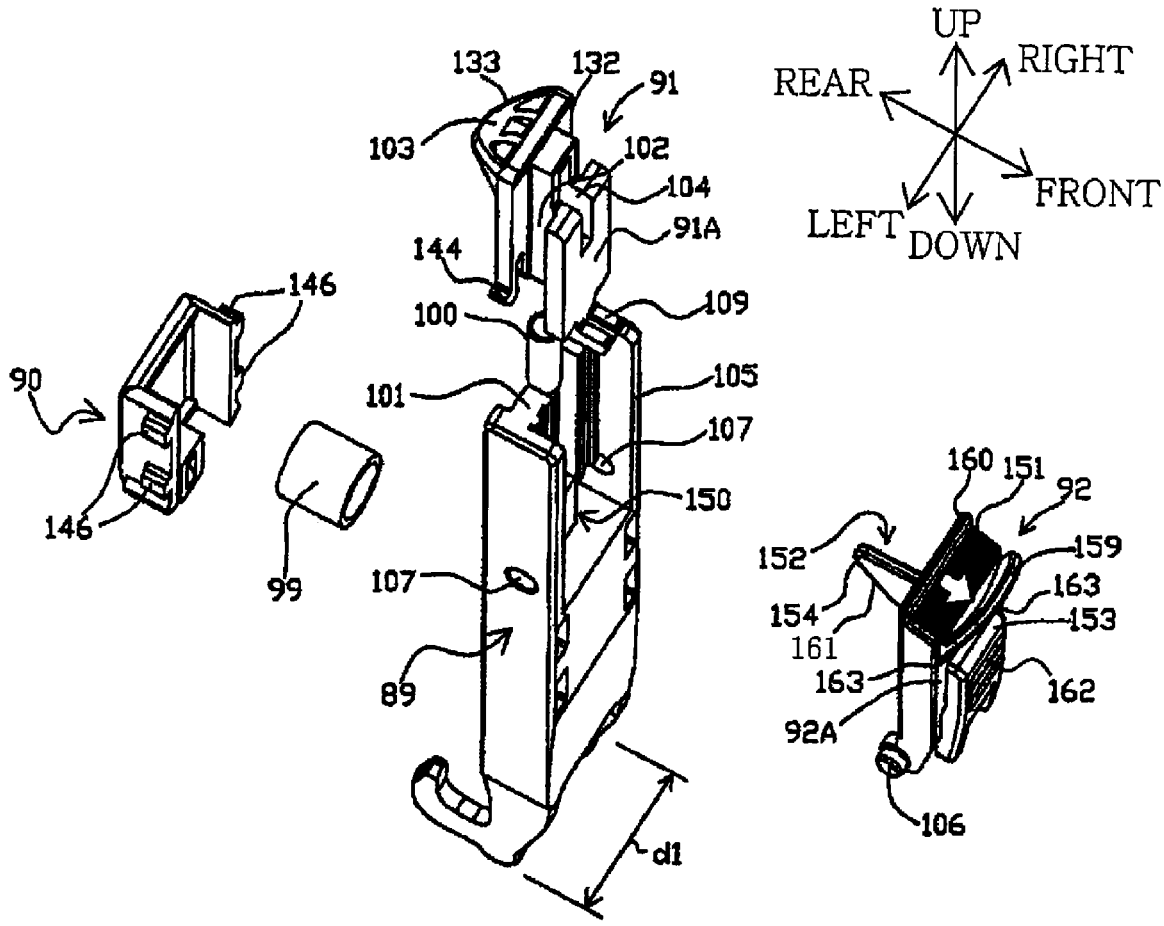
FIG. 12 is an exploded perspective view showing a door unit of the refill unit.
Figure 13:
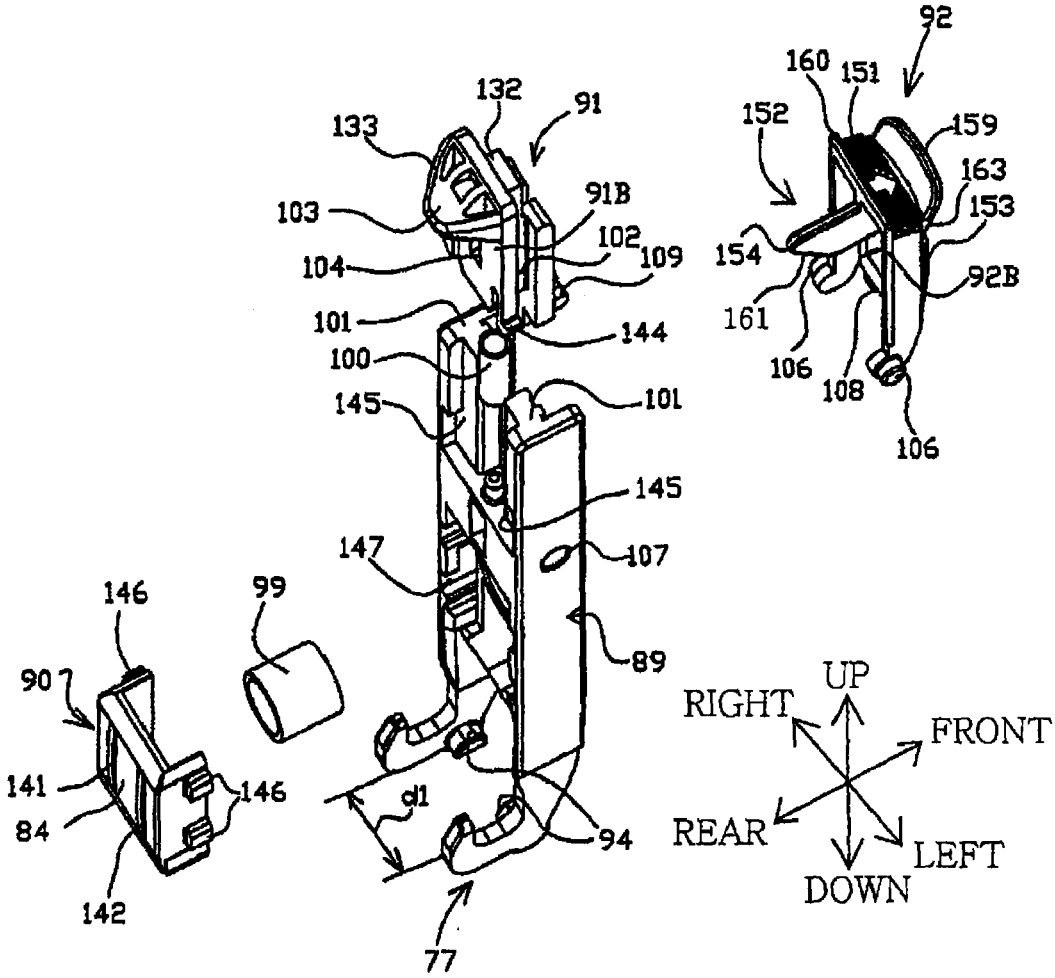
FIG. 13 is an exploded perspective view showing the door member of the refill unit.

FIG. 11 is the cross-section view of the body of the refill unit 74 in the state in which the door unit 76 is opened. FIGS. 12 and 13 are exploded perspective views showing the door unit 76 of the refill unit 74.

The door unit 76 is opened and closed to uncover and cover the opening 88. The door unit 76 is provided per the opening 88 which is provided in the corresponding accommodation 78 of the corresponding ink cartridge 63. Each of the doors 76 can be pivotably displaced between the following two postures: (a) a closed posture, i.e., a closed position, in which the corresponding ink cartridge 63 cannot be replaced because the corresponding opening 88 is covered by the corresponding door unit 76 and (b) an open posture, i.e., an open position, in which the corresponding ink cartridge 63 can be replaced because the corresponding opening 88 is uncovered by the corresponding door unit 76 (shown in FIG. 5). If the door unit 76 is held in the closed posture, the corresponding ink cartridge 63 is reliably and firmly held by the corresponding accommodation 78. Meanwhile, if the door unit 76 is held in the open posture, the corresponding ink cartridge 63 can be easily attached to, and detached from, the corresponding accommodation 78.

As shown in FIGS. 12 and 13, the door unit 76 includes a door body 89 as a door, a retaining member 90 that is attached to the door body 89, a locking member 91, and a release lever 92 (i.e., a releasing member), all of which are made of the resin. The door body 89 has an elongated rectangle plate shape. An external shape of the door body 89 corresponds to a shape of the opening 88. On a lower end portion 93 of the door body 89, there is provided pivot shaft portions 94, 94 which are integrally formed with the door body 89 and which are supported by a lower portion of the front face 79 of the case 75. More specifically, on a front end portion of the bottom wall portion 80 of the case 75, there is provided a bearing 95 to which the pivot shaft portions 94, 94 are rotatably fitted. Owing to this arrangement, the door body 89 is capable of covering the corresponding opening 88 in a standing posture as shown in FIGS. 5 and 14, and capable of uncovering the corresponding opening 88 in a falling-down posture as shown in FIGS. 5 and 6. In the present embodiment, the bearing 95 is provided on the front end portion of the bottom wall portion 80 of the case 75. However, the bearing 95 is not limited to be embodied with the above-described arrangement, but may be embodied with an arrangement in which the bearing 95 is provided on the box-like body which supports the case 75.

On the lower end portion 93 of the door body 89, there is provided the pair of drawer portions 77, 77 each of which is integrally formed with the door body 89. Each of the drawer portions 77, 77 has a substantially L-shape and includes an extend potion 96 and a bent portion 97. The extend portion 96 is provided continuously with the lower end portion 93 of the door body 89. As shown in FIG. 6, in the state in which the door unit 76 is held in the closed posture, the extend portion 96 extends from the lower end portion 93 toward the rear side. The bent portion 97 extends, in a direction in which the door body extends, continuously from the rear end portion of the extend portion 96 at an angle of almost 90 degrees thereto. In the state in which the door unit 76 is held in the closed posture, a distal end of the bent portion 97 projects upwardly to be positioned in a position higher than the above-described placing surface 98. The door body 89 is pivotable about the pivot shaft portions 94, 94, and accordingly, the pair of drawer portions 77, 77 each having a substantially L-shape is also pivotable about the pivot shaft portions 94, 94, as shown in FIGS. 6 and 11. Owing to this arrangement in which the pair of drawer portions 77, 77 is pivotable, the corresponding ink cartridge 63 accommodated in the corresponding accommodation 78 is withdrawn therefrom, to be described later.

As shown in FIG. 11, when the door unit 76 is displaced from the closed posture to the open posture, the bent portions 97, 97 of the pair of drawer portions 77, 77 are pivoted about the pivot shaft portions 94, 94 in a direction indicated by "Q" (shown in FIG. 6). In this state, by pivoting of the bent portions 97, 97, each of outer surfaces 110, 110 of the bent portions 97, 97 is displaced from a standing posture in which each of the outer surfaces 110, 110 extends in a vertical direction (shown in FIG. 14) toward a falling-down posture in which each of the outer surfaces 110, 110 extends in a horizontal direction (shown in FIG. 6). A length of the extend portion 96 of each of the drawer portions 77, 77 is set as a predetermined suitable amount Therefore, when the bent portions 97, 97 are pivoted, each of the outer surfaces 110, 110 of the bent portions 97, 97 is located slightly higher than the placing surface 98, namely, positioned above a extension of the placing surface 98 so as to extend in the forward and backward direction. In the state in which the door unit 76 is held in the open posture, each of the outer surfaces 110, 110 of the bent portions 97, 97 functions as a guide surface for guiding the corresponding ink cartridge 63 onto the placing surface 98 in the corresponding accommodation 78. That is, the pair of drawer portions 77, 77 is for guiding a new ink cartridge 63 into the corresponding accommodation 78 as well as for drawing out the corresponding ink cartridge 63 from the corresponding accommodation 78.

In the present embodiment, each of the door body 89 includes the pair of drawer portions 77, 77. As shown in FIG. 13, the pair of drawer portions 77, 77 is disposed so as to be opposite to each other in a widthwise direction of the door body 89.111 this arrangement, the ink cartridge 63 is put between the pair of drawer portions 77, 77 in the widthwise direction for supporting the ink cartridge 63. Further, in the present embodiment, a width, "d1", between the pair of drawer portions 77, 77 (shown in FIG. 12) is set to be smaller than a distance, "d2" of the ink cartridge 63 (shown in FIG. 20). There will be more specifically described effects of the above-described arrangement later.

As shown in FIGS. 5, 6, 10, 11, 12, 13, and 14, the retaining member 90 is provided on a rear face of the door body 89. On each of opposite side surfaces of the retaining member 90, a pair of hooks 146, 146 is provided. On the door body 89, four hook catch portions 147 are provided. Each of the four hooks 146 projects from a corresponding one of the opposite side surfaces of the retaining member 90. Each of the four hook catch portions 147 has a recess which extends in the forward and backward direction on the door body 89. The hooks 146 are slidably fitted into the hook catch portions 147, respectively, such that the retaining member 90 is capable of moving in the forward and backward direction relative to the door body 89, as shown in FIGS. 12 and 13. Therefore, the retaining member 90 can be displaced between following two position: (a) an advanced position in which the retaining member 90 is advanced from a rear face of the door body 89, as shown in FIG. 6 and (b) a retracted position in which the retaining member 90 is retracted from the advanced position, as shown in FIG. 14. As shown in FIGS. 12 and 13, a coil spring 99 (a biasing member) is interposed between the retaining member 90 and the door body 89. Therefore, the retaining member 90 is elastically biased at all times by the coil spring 99 such that the retaining member 90 is held in the advanced position (shown in FIG. 6).

Figure 15:
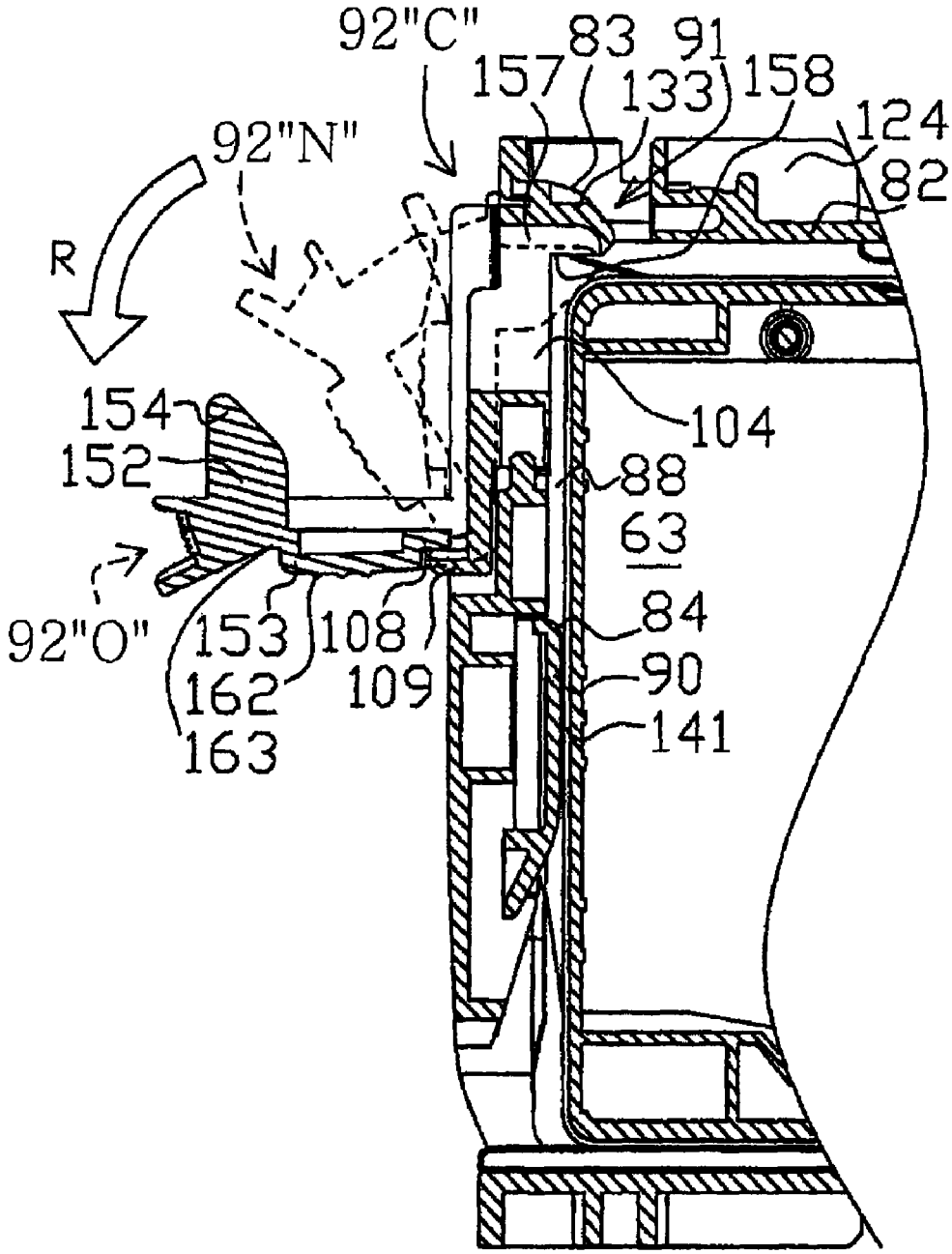
FIG. 15 is an enlarged cross-sectional view showing a the door unit.

As shown in FIGS. 14 and 15, the retaining member 90 is held in contact with a front surface of the ink cartridge 63 when the door unit 76 is held in the closed posture. In this state, since the ink cartridge 63 relatively presses the retaining member 90, the retaining member 90 is displaced toward the retracted position. Then, the ink cartridge 63 receives an elastic force of the coil spring 99 via the retaining member 90 so as to be pushed in the backward direction, whereby the ink cartridge 63 is reliably and firmly held so as not to have a large amount of play relative to the corresponding accommodation 78. Accordingly, it is possible to reliably avoid a leakage of the ink from the ink supply valve 115 of the ink cartridge 63.

In the present embodiment, the retaining member 90 has generally flat plate shape. A main surface 84 of the retaining member 90, namely, a surface which faces the front surface of the ink cartridge 63 when the door unit 76 is held in the closed posture, is generally flat. As shown in FIGS. 5 and 13, on the main surface 84, there is provided a pair of projections, 141, 142. If the door is held in the closed posture, the pair of projections, 141, 142 is held in contact with the front surface of the ink cartridge 63 so as to press the ink cartridge 63. The pair of projections 141, 142 is located to be spaced apart from each other by a predetermined distance is interposed therebetween in a widthwise direction of the door unit 76. In this arrangement, the retaining member 90 is not held in contact with a seam portion 143 (shown in FIGS. 20 and 21) of the ink cartridge 63, but is held in contact, at, the pair of projections, 141, 142, with opposite end portions of the seam portion 143, when the door unit 76 is held in the closed posture.

Figure 16:
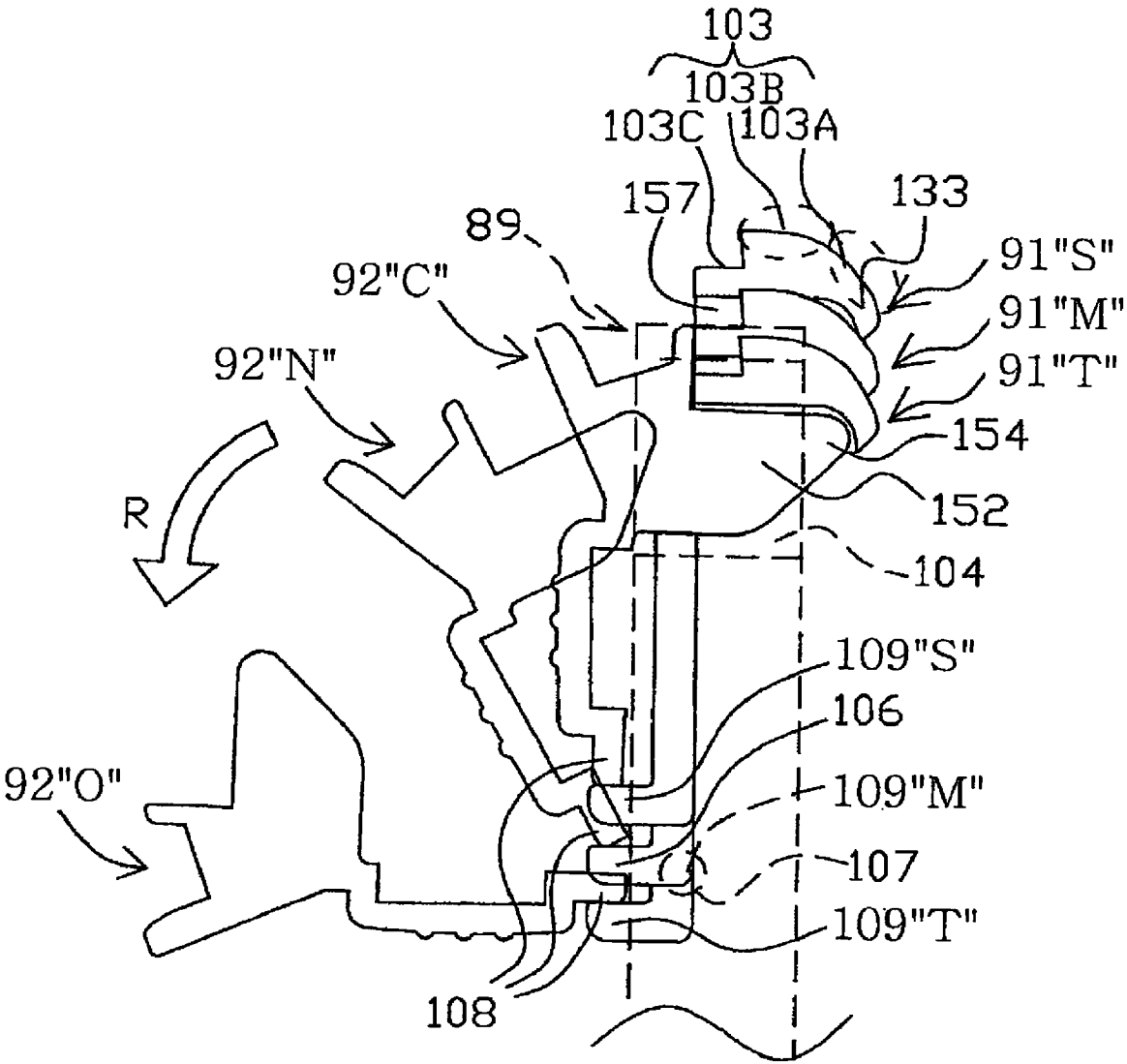
FIG. 16 is a view schematically showing a movement of a locking member and a release lever of the refill unit.
Figure 17B:
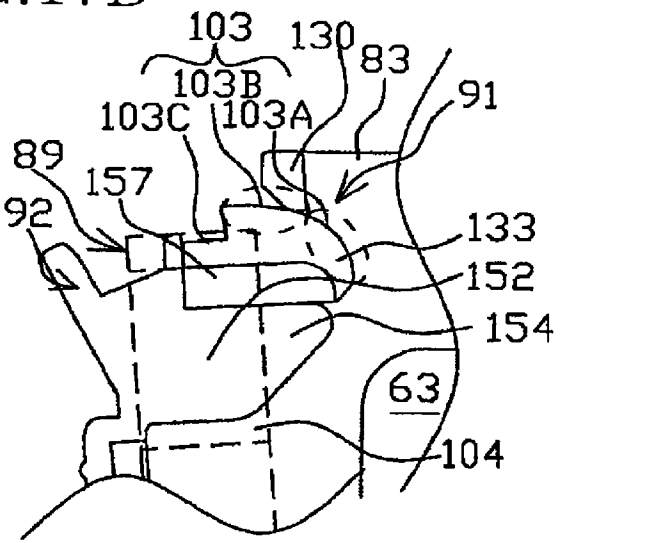
FIG. 17B is a view schematically showing a movement of the locking member and the release lever of the refill unit.
Figure 17D:
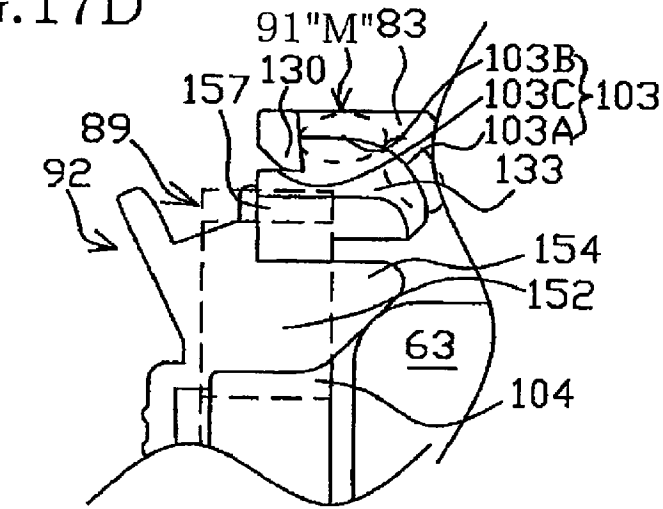
FIG. 17D is a view schematically showing a movement of the locking member and the release lever of the refill unit.
Figure 17A:
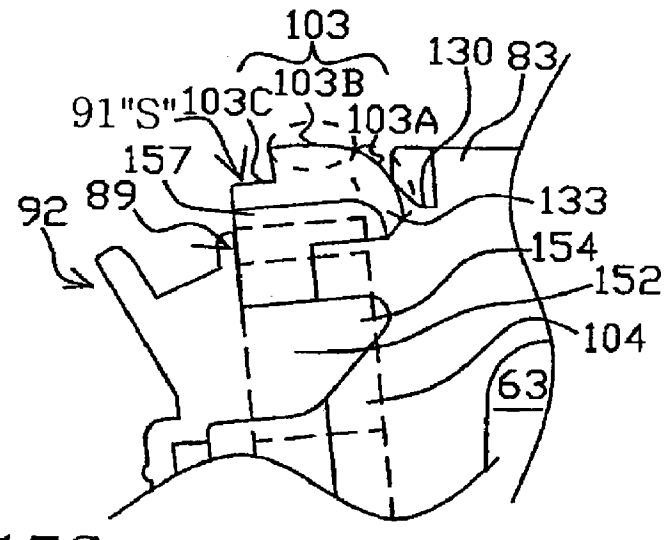
FIG. 17A is a view schematically showing a movement of the locking member and the release lever of the refill unit.
Figure 17C:
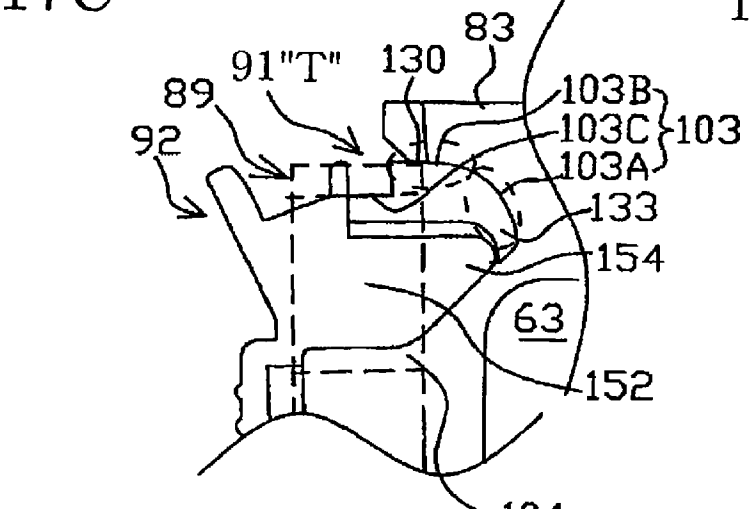
FIG. 17C is a view schematically showing a movement of the locking member and the release lever of the refill unit.
Figure 18B:
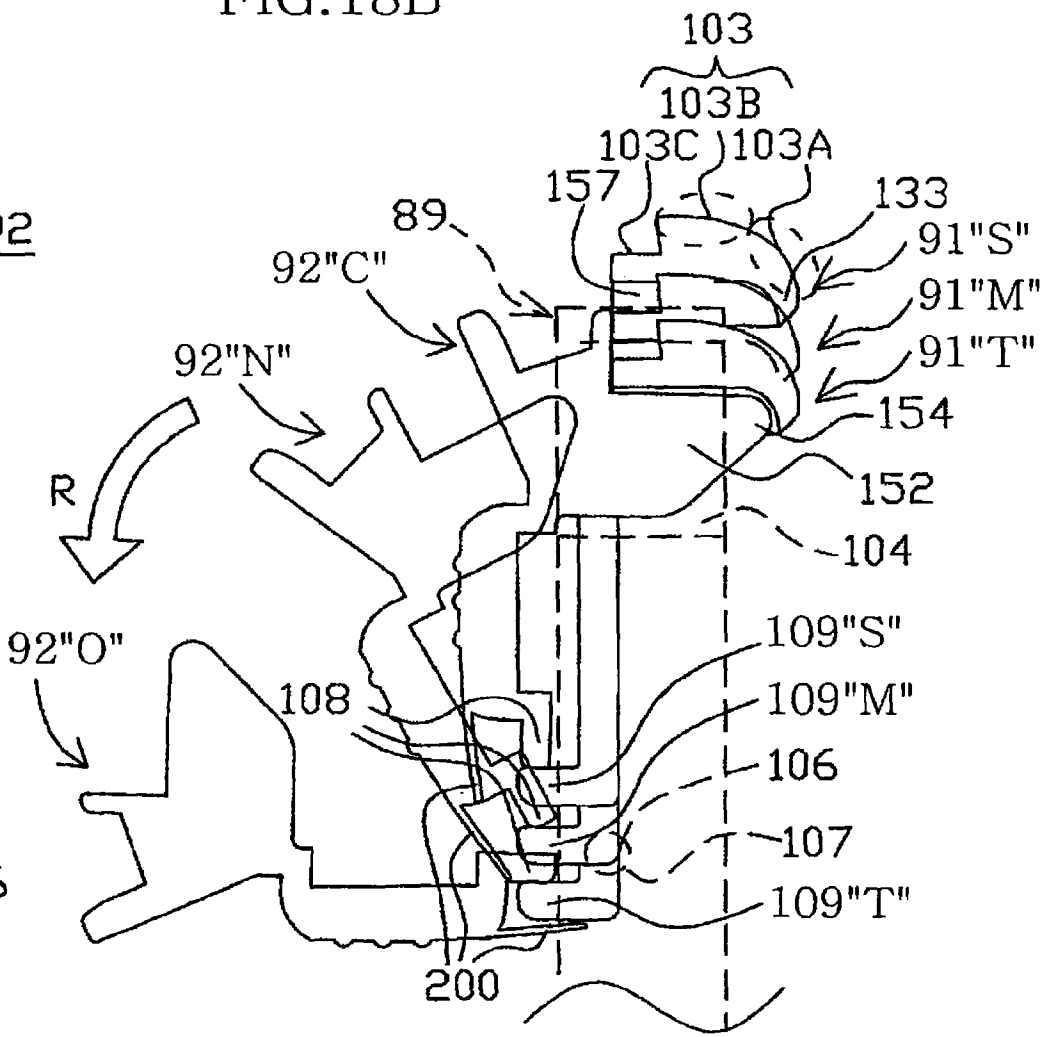
FIG. 18B is a view schematically showing a movement of the locking member and the converted release lever of the refill unit.
Figure 18A:
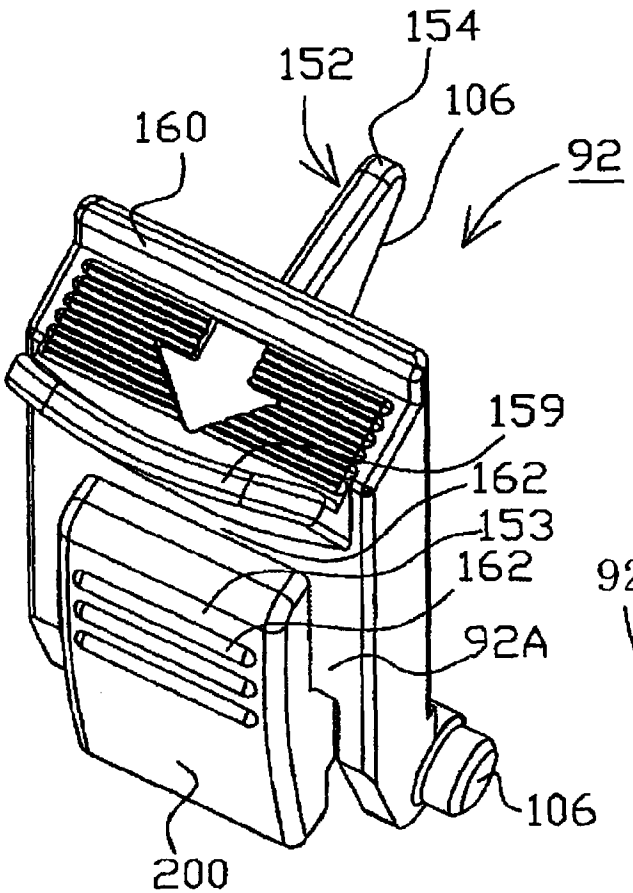
FIG. 18A is a diagonal view of a converted release lever of the refill unit as an example.

As shown in FIGS. 12 and 13, the locking member 91 is provided on an upper end portion of the door body 89. The locking member 91 includes: a main stem portion 132; a locking portion 133, i.e., an engaging portion, which is integral with an upper end portion of the main stem portion 132 and which projects toward inside of the case 75; a seat portion 109, i.e., a contact portion, which is integral with a lower end portion of the main stem portion 132 and which projects from a front face 91A of the looking member 91. In a state in which the locking member 91 is fitted in the door body 89, the seat portion 109 is protruded from a front face 105 of the door body 89, as shown in FIGS. 14, 15, and 16. The front face 91A of the locking member 91 and the seat portion 109 constitute an exposed portion which is exposed in the front face 105 of the door body 89. Further, as shown in FIG. 15, a through-hole 104, i.e., an aperture, is formed through the looking member 91 so as to extend from the front face 91A thereof to a rear face 91B thereof which is opposite to the front face 91A and which faces the interior of the accommodation 78. An extend-hole 157 is continuously formed with the through-hole 104 and extended from a lower surface 158 of the locking portion 133 toward inside of the locking portion 133. A later-described triangular projection 152, i.e., an interference preventing portion, is inserted through the through-hole 104. As shown in FIGS. 12 and 13, the through-hole 104 and the extend-hole 157, as a whole, have a hole-structure which extends by predetermined length in the vertical direction. Accordingly, owing to the extend-hole 157, the looking member 91 is not held in contact with the triangular projection 152 even if the looking member 91 is moved to a position in which the looking member 91 is nearly held in contact with the triangular projection 152. It is noted that the through-hole 104 and the extend-hole 157, as a whole, function as an accommodating portion which accommodates the triangular projection 152.

The looking member 91 is supported by the door body 89 so as to be movable in the upward and downward directions relative to the door body 89. On the upper end portion of the door body 89, there is provided a pair of slide rails 101, 101 each of which extends in the vertical direction. Further, on the main stem portion 132 of the looking member 91, there is provided a pair of slide recesses 102, 102 each of which extends in the vertical direction, as shown in FIGS. 12 and 13. Each of the pair of slide rails 101, 101 is slidably fit in a corresponding one of the pair of slide recesses 102, 102, such that the looking member 91 is slidably moved in the upward and downward directions.

On opposite side surfaces of the main stem portion 132, there is provided a pair of hooks 144, 144, respectively. Each of the pair of hooks 144, 144 projects outwardly from the side surface of the main stem portion 132. In a state in which the looking member 91 is fitted in the door body 89, the pair of hooks 144, 144 are accommodated in a pair of hook catch portions 145, 145 which is provided on the door body 89, respectively, as shown in FIGS. 5 and 13. Each of the pair of hook catch portions 145, 145 is defined by a recess which extends by predetermined distance in the vertical direction. Therefore, if the locking member 91 is slidably moved in the upward and downward directions, each of the hooks 144, 144 is brought into contact with a inner surface of the corresponding hook catch portion 145. Accordingly, a slide movement of the locking member 91 in the upward and downward directions is limited.

A length of the above-described recesses which form the hook catch portions 145, 145, respectively, is set at a predetermined amount, whereby slidable range of the locking member 91 is limited. When the locking member 91 is slidably moved upwardly with respect to the door body 89, each of the hooks 144, 144 is brought into contact with an upper edge portion of the inner surface of the corresponding hook catch portion 145. Accordingly, the locking member 91 is held in a posture, i.e., a protruding posture "S" (an engaging position) in which the locking member 91 protrudes from the upper end portion of the door body 89, as shown in FIG. 16. Meanwhile, when the locking member 91 is slidably moved downwardly with respect to the door body 89, each of the hooks 144, 144 is brought into contact with a lower edge portion of the inner surface of the corresponding hook catch portion 145. Accordingly, the locking member 91 is held in a retracting posture "T" (a releasing position) in which the locking member 91 retracts toward inside of the door body 89, as shown in FIG. 16.

As shown in FIG. 13, a coil spring 100 which constitutes a biasing mechanism is interposed between the locking member 91 and the door body 89. The coil spring 100 generates a biasing force to bias the locking member 91. Therefore, the locking member 91 is biased by the coil spring 100 such that the locking member 91 is protruded upwardly from the upper end portion of the door body 89 at all times, namely, such that the locking member 91 is held in the protruding posture "S".

As shown in FIGS. 12 and 13, the release lever 92 has a generally rectangle plate shape. The triangular projection 152 is provided on a rear face 92B of the release lever 92, and a convex portion 153, i.e., a protruding portion, is provided on a front face 92A of the release lever 92. Further, a first engagement projection 159 (a first engagement portion) and a second engagement projection 160 (a second engagement portion) project upwardly from an upper surface 151 of the release lever 92. More specifically, the first engagement projection 159 is formed on a boundary between an upper edge portion of the front face 92A and a front edge portion of the upper surface 151 of the release lever 92, and has a curved shape which is convex upwardly and forwardly more than the convex portion 153. The second engagement projection 160 is formed on a boundary between an upper edge portion of the rear face 92B and a rear edge portion of the upper surface 151 of the release lever 92. Therefore, a recess is formed between the first engagement projection 159 and the second engagement projection 160. Between the first engagement projection 159 and the convex portion 153, a concave portion 163 is formed. There will be more specifically described effects of the above-described arrangement later.

The convex portion 163 has a concaved shape which opens downwardly, namely, in a downward direction in FIG. 12, and which surrounds a pressing portion 108 which is provided on a lower edge portion of the rear face 92B.

The triangular projection 152 having a plate-like shape projects from a center portion of the rear face 92B of the release lever 92 in the horizontal direction so as to extend in a direction perpendicular to the rear face 92B. On a distal end portion 154 of the triangular projection 152, there is formed an inclined end surface which is inclined from a down side toward an up side (shown in FIGS. 12 and 13). The triangular projection 152 is provided on an upper portion of the front face 105 of the door body 89.

In the present embodiment, as shown in FIGS. 12 and 13, the door body 89 includes an accommodation 150 which accommodates the release lever 92. The accommodation 150 is defined by a concave portion of the door body 89. The release lever 92 is fitted in the accommodation 150 when the release lever 92 is displaced in a later-described posture.

On lower end portions of the release lever 92, there is provided support pins 106, 106, respectively, which define a pivot axis. On the other hand, on the door body 89, there is provided a pair of support pin receiving holes 107, 107. The support pins 106, 106 are fitted in the support pin receiving holes 107, 107, respectively, such that the release lever 92 is pivotable about the support pins 106, 106. More specifically, as shown in FIGS. 15 and 16, the release lever 92 can be pivotably displaced in following three postures: (a) an accommodated posture "C", i.e., a first posture, in which the release lever 92 stands upright so as to be substantially parallel to the front face 105 of the door body 89, (b) a neutral posture "N", i.e., a third posture, in which the release lever 92 is inclined by an angle of approximately 45°, and (c) a laid posture "O", i.e., a second posture, in which the release lever 92 is laid down such that a longitudinal direction of the release lever 92 is almost parallel to a horizontal direction.

On the upper surface 151 of the release lever 92, an arrow is marked. An operational direction of the release lever 92 is clearly indicated by the above-described arrow. Further, from the upper surface 151 of the release lever 92, the first engagement projection 159 and the second engagement projection 160 project upwardly. More specifically, the first engagement projection 159 has the curved shape which is convex upwardly so as to fit a shape of a finger of the operator. There will be more specifically described effects of the above-described arrangement later.

In the present embodiment, in the state in which both of the locking member 91 and the release lever 92 are fitted in the door body 89 when the release lever 92 is held in the accommodated posture "C", the triangular projection 152 is inserted into the through-hole 104 such that the distal end portion 154 of the triangular projection 152 is protruded over the rear face 91B of the locking member 91. When the release lever 92 is held in the neutral posture "N" or the laid posture "O", the triangular projection 152 is pulled out from the through-hole 104, as shown in FIGS. 15 and 16.

Further, as shown in FIGS. 15 and 16, in all of the state that the release lever 92 is held in the accommodated posture "C", the neutral posture "N" or the laid posture "O", the convex portion 153 is protruded from the front face 105 of the door body 89 over the seat portion 109. There will be more specifically described effects of the above-described arrangement later.

Hereinafter, there will be described a movement of the locking member 91 caused by a movement of the door unit 76 in which the door unit 76 is displaced from the open posture toward the closed posture by reference to FIGS. 17A, 17B, 17C, and 17D. It is noted that the release lever 92 is held in the accommodated posture "C" in this state. As shown in FIGS. 17A-17D, an upper surface 103, i.e., a pressing-force receiving surface, of the locking portion 133 of the locking member 91 includes an inclined surface or a slant surface which is inclined downwardly and a step portion 103C which is stepped down from the inclined surface (toward the downward direction shown in FIGS. 12 and 13). The above-described inclined surface includes: a gradual slant portion 103B which extends from a top portion to a middle portion of the inclined surface; and a steep slant portion 103A which extends from the middle portion to a bottom portion of the inclined surface. Further, the steep slant portion 103A and the gradual slant portion 103B are integrally formed so as to form a continuous curved surface in which an inclination thereof becomes smaller in the gradual slant portion 103B than in the steep slant portion 103A. There will be more specifically described effects of the above-described arrangement later.

In the state in which both of the locking member 91 and the release lever 92 are fitted in the door body 89, respectively, and in which the locking member 91 is held in the protruding posture "S" and the release lever 92 is held in the accommodated posture "C", the pressing portion 108 which is provided on a lower edge portion of the rear face 92B of the release lever 92 is held in contact with the seat portion 109 as shown in FIGS. 12, 13, 14, 15, and 16. The pressing portion 108 functioning as an inter-lock cam is provided for sliding the locking member 91 in the upward and downward directions in correspondence to displacement of the release lever 92, as shown in FIGS. 14, 15, and 16. As described later, owing to the pressing portion 108, if the release lever 92 is pivoted from the accommodated posture "C" to the neutral posture "N", then to the laid posture "O", the locking member 91 slides from the protruding posture "S" to an middle posture "M" (a mode of a transitional state), then to the retracting posture "T", as shown in FIG. 16. In other words, when the locking member 91 is held in the protruding posture "S", the release lever 92 is held in the accommodated posture "C". If the door unit 76 is completely closed and the locking member 91 is held in the middle posture "M", the release lever 92 is movable between the accommodated posture "C" and the neutral posture "N". In this state, center of gravity of the release lever 92 is predetermined such that the release lever 92 is normally in the neutral posture "N" due to its own weight.

As shown in FIGS. 12, 13, 14, 15, and 16, the pressing portion 108 of the release lever 92 is brought into contact with the seat portion 109 of the locking member 91. The pressing portion 108 of the release lever 92 and the seat portion 109 of the locking member 91 cooperatively functions as an interdependent mechanism for displacing the locking member 91. In the state in which the door unit 76 is completely closed (as shown in FIG. 14), the release lever 92 is ought to be pivoted further in a direction indicated by an arrow "R" due to its own weight. That is, the release lever 92 is supposed to cause, via the pressing portion 108, a pivotable movement of the locking member 91 further in a direction in which the release lever 92 gives a pressing force downwardly. However, the locking member 91 is biased upwardly by the coil spring 100 all the time, whereby the locking member 91 is not displaced by the pressing force of the release lever 92, but kept in the middle posture "M".

However, as shown in FIGS. 15 and 16, when the release lever 92 is forcedly pivoted further toward the arrow "R", for example, when the operator operates the release lever 92 to be pivoted in order to replace the ink cartridges 63, the release lever 92 is pivoted toward the laid posture "O". As shown in FIG. 16, in the state in which the release lever 92 is held in the laid posture "O", the pressing portion 108 is pivoted about the pair of support pins 106, 106 so as to push down the seat portion 109 of the locking member 91. Accordingly, the locking member 91 is moved downwardly while resisting an elastic force of the coil spring 100 such that the locking member 91 is held in the retracting posture "T". In other words, in the state in which the locking member 91 is held in the retracting posture "T", the release lever 92 is capable of changing its posture between the accommodated posture "C" and the laid posture "O". However, as described above, in this state, the release lever 92 is held in the laid posture "O" all the time due to its predetermined center of gravity. Further, when the locking member 91 is displaced in the retracting posture "T", the lock of the door unit 76 is released. Accordingly, the door unit 76 can be displaced from the closed posture to the open posture.

As described above, the ink cartridge 63 is elastically biased by the retaining member 90 backward, namely, in a backward direction in which the ink cartridge 63 is inserted into the corresponding accommodation 78. Further, as described above, the ink cartridge 63 is forwardly biased by the push rod 85A provided on a back surface 114 of the ink cartridge 63, namely, in a forward direction in which the ink cartridge 63 is withdrawn from the corresponding accommodation 78. Therefore, owing to biasing forces of the retaining member 90 and the push rod 85A, the ink cartridge 63 relatively biases the door unit 76 such that the door unit 76 is displaced toward the open posture. If the locking member 91 is displaced toward the retracting posture "T", by the above-described biasing forces. The door unit 76 is displaced from the closed posture to the open posture. In other words, the operator can easily open the door unit 76 by performing only one action, pushing down the release lever 92 such that the release lever 92 is displaced from the accommodated posture "C" to the laid posture "O", namely, the door unit 76 is displaced from the closed posture to the open posture.

From the upper surface 151 of the release lever 92, the first engagement projection 159 and the second engagement projection 160 project upwardly. More specifically, the first engagement projection 159 has the curved shape in which a finger of the operator can easily fit thereto. Owing to this arrangement, the operator can easily operate the release lever 92 because the finger of the operator is steadily held on the first engagement projection 159 and the second engagement projection 160. When the release lever 92 is displaced in the laid posture "O", the finger of the operator is brought into contact with the triangular projection 152 and the second engagement projection 160. Therefore, the operator can reliably operate the release lever 92. Also, it is possible to prevent a collision between the door unit 76 and the finger of the operator caused by the above-described biasing forces of the retaining member 90 and the push rod 85A. More specifically, when the release lever 92 is displaced in the laid posture "O", a direction in which the door unit 76 is pivoted becomes almost perpendicular to the front face 92A of the release lever 92. In this state, the finger of the operator who is operating the release lever 92 tends to receive a force due to displacement of the door unit 76 from the closed posture to the open posture. However, since the triangular projection 152 is provided on the release lever 92, contact area in which the finger of the operator and the release lever 92 contact with each other is relatively large. Therefore, the operator can reliably support the release lever 92 by his/her own finger, thereby making it possible to prevent the collision between the door unit 76 and the finger of the operator caused by the above-described biasing forces of the retaining member 90 and the push rod 85A.

The locking member 91 receives the elastic force of the above-described coil spring 100 all the time. Therefore, the locking member 91 is brought to be most protruded over the door body 89 when a force by which the release lever 92 is pivoted is lost, namely, when the operator releases the release lever 92. In this state, the locking member 91 is forced to be displaced toward the accommodated posture "C". That is, as shown in FIG. 11, where the door unit 76 is held in the open posture, the release lever 92 is accommodated in the door body 89. Therefore, as shown in FIGS. 1, 5, and 11, since the release lever 92 is accommodated in the door body 89 when the ink cartridge 63 is exchanged, the door unit 76 can be pivoted about the pivot shaft portions 94, 94 toward the open posture in which a longitudinal direction of the door unit 76 is almost in parallel to the horizontal direction. Accordingly, the operator can easily exchange the ink cartridge 63. As shown in FIG. 11, the first engagement projection 159 and the convex portion 153 both of which are provided on the release lever 92 are held in contact with an inner surface of the opening-closing lid 72, whereby the release lever 92 is positioned in the vertical direction. In this state, the triangular projection 152 provided on the release lever 92 is kept to be protruded over the rear face 91B of the locking member 91. Also in this state, a prolongation line "L" of an inclined end surface 161 of the triangular projection 152 does not intersect with the locking portion 133 of the locking member 91. Therefore, when the ink cartridge 63 is withdrawn from the corresponding accommodation 78 by the operator, the ink cartridge 62 is moved along the inclined end surface 161 of the triangular projection 152, and passed above the locking portion 133 of the locking member 91, as shown in the FIG. 11. Accordingly, the ink cartridge can be smoothly detached from the corresponding accommodation without being caught by the locking portion 133. The locking portion 133 has an isosceles triangle shape if the upper surface thereof is viewed from above in the FIGS. 12 and 13. A base of the isosceles triangle shape is defined by an upper edge of the main stem portion 132. If the ink cartridge 63 is slant to the right side or left side (i.e., in the leftward and rightward directions indicated in FIG. 5) when the ink cartridge 63 is moved along the inclined end surface 161 of the triangular projection 152, and passed above the locking portion 133 of the locking member 91, the ink cartridge can be smoothly detached from the corresponding accommodation without catching the locking portion 133.

The pair of projections, 141, 142 provided on the main surface 84 of the retaining member 90 cooperates with a guide portion interposed between the later-described bent portion 97 to guide the ink cartridge 63 when the ink cartridge 63 is inserted into the corresponding accommodation 78. When the ink cartridge 63 is inserted into the corresponding accommodation 78, the operator put the ink cartridge 63 on the pair of projections, 141, 142 such that a bottom surface of the ink cartridge 63 is brought into contact with upper surfaces of the pair of projections, 141, 142, and such that an end portion of the ink cartridge 63 is put on the bent portion 97. Then, the operator pushes the ink cartridge 63 into the corresponding accommodation 78 such that the ink cartridge 63 is accommodated therein.

In the normal operation state of the MFD 10, the door unit 76 of the refill unit 70 is closed and the release lever 92 is held in the neutral posture "N". As shown in FIG. 1, if the opening-closing lid 72 is opened when the ink cartridge 63 is exchanged, the release lever 92 is inclined toward the operator. Therefore, the operator can easily operate the release lever 92. In this state, the operator is able to see the release lever 92, whereby the operator can detach the ink cartridge 63 from the corresponding accommodation 78 by operating the release lever 92 without having a tough posture, such as squatting down.

As shown in FIG. 1, the refill unit 70 is disposed on the front face 71 of the MFD 10. If the release lever 92 is held in the neutral posture "N", namely, forwardly inclined, large space needs to be secured in the MFD 10 in order to accommodate the refill unit 70. Therefore, in the MFD 10, the refill unit 70 needs to be disposed at a position nearer to the rear side than a vicinity of the above-described opening 73. In this arrangement, there is a risk that an external dimension of the MFD 10 becomes larger.

However, in the present embodiment, when the door unit 76 is held in the closed posture with respect to the case 75, the release lever 92 is pivotable by being displaced between the neutral posture "N" and the accommodated posture "C". Therefore, the refill unit 70 can be disposed at a position near to the above-described opening 73. It is because that the inner surface of the opening-closing lid 72 is brought into contact with the release lever 92 when the opening-closing lid 72 is closed such that the opening-closing lid 72 pushes the release lever 92, whereby the release lever 92 is displaced toward the accommodated posture "C". Therefore, in the present embodiment, the MFD 10 can be downsized. In the state in which the opening-closing lid 72 is closed, the release lever 92 is held in the accommodated posture "C". In this state, the triangular projection 152 is held in contact with the ink cartridge 63, whereby a movement of the ink cartridge 63 is limited. Therefore, if the MFD 10 is moved in the state in which the ink cartridge 63 is accommodated in the corresponding accommodation 78, a displacement of the ink cartridge 63 can be prevented Accordingly, it is possible to reliably obviate the leakage of the ink from the ink supply valve 116 of the ink cartridge 63.

There will be described a structure of the ink cartridge 63 by reference to FIGS. 19 and 20.

The ink cartridge 63 is for storing the ink in advance and includes a cartridge body 111 and an ink storing element, i.e., an ink storing means, not shown, which is accommodated in the cartridge body 111. In the present embodiment, the refill unit 70 is configured to accommodate the four ink cartridges 63 which store mutually different color inks, i.e., cyan ink, magenta ink, yellow ink, and black ink. As apparently shown in FIGS. 1 and 5, the ink cartridge 63 which stores black color ink is slightly larger than the other three ink cartridges 63 in thickness. It is because that, commonly, larger amount of the black color ink is consumed than the other three color inks. The other three ink cartridges 63 except the ink cartridge 63 storing the black color ink have a same structure.

The cartridge body 111 is made of the resin. In the present embodiment, the cartridge body 111 has a thin rectangular parallelpiped shape and has an inner space which is defined as an ink storing space. The cartridge body 111 is formed by two tray-like members 112, 113 which are united to each other by welding, or by other fixing means. By uniting the two tray-like members 112, 113, the seam portion 143 is formed.

On the back side of the cartridge body 111 in which the back surface 114 is formed, an air-introducing valve 85 (an air introducing portion) is provided. From the air-introducing valve 85, the push rod 85A is backwardly projected. In the present embodiment, a check valve is disposed on an inner portion of the air-introducing valve 85. The push rod 85A is biased by the check valve in a direction in which the push rod 85A projects from the back surface 114 of the ink cartridge 63. When the ink cartridge 63 is accommodated in the case 75, the push rod 85A provided on the air-introducing valve 85 is held in contact with the rear wall portion 69 of the case 75 such that the push rod 85A is pushed back into inside of the ink cartridge 63. Further, the ink supply tube, not shown, is inserted into the ink supply valve 115 of the ink cartridge 63.

Where the push rod 85A is pushed back into the inside of the ink cartridge 63, the above-described check valve is opened such that air is introduced, via the air-introducing valve 85, into the inside of the ink cartridge 63. Accordingly, the ink stored in the ink cartridge 63 is smoothly supplied to the recording head 27.

Further, on the back side of the ink cartridge 63, there is provided the liquid level detecting portion. As described above, on the rear wall portion 69 of the case 75, the plurality of connecters 86 for liquid level detectors 87 are provided, as shown in FIGS. 6, 11, and 14. The liquid level detector 87 is connected to the corresponding one of the connecters 86, as shown in FIGS. 19 and 20. When the ink cartridge 63 is accommodated in the corresponding accommodation 78, the corresponding liquid level detector 87 is fitted into the liquid level detecting portion of the ink cartridge 63 so that the liquid consumption level of the ink stored in the ink cartridge 63 can be detected. A structure of the liquid level detecting portion of the ink cartridge 63 is not specifically limited. Also, a structure of the liquid level detector 87 is not specifically limited, but may be embodied with a conventional sensor.

On a lower side of the cartridge body 111 in which a lower surface 155 is formed, a pair of fitting recesses 116, 116 is provided. As shown in FIG. 20, the pair of fitting recesses 116, 116 are formed on respective corner portions which are located on respective boundaries between respective side face and a bottom face of the cartridge body 111. Each of the fitting recesses 116, 116 has a concaved shape which extends in a longitudinal direction of the cartridge body 111. In the present embodiment, the pair of fitting recesses 116, 116 are symmetrically provided on right and left sides of the cartridge body 111, respectively, in the horizontal direction, as shown in FIG. 5. As shown in FIG. 19, each of the fitting recesses 116, 116 includes: a shallow portion 118 which opens on the back surface 114 of the cartridge body 111, which is continuously formed with the same back surface 114, and which extends toward a front surface 117 of the cartridge body 111; a boundary portion 119 which is continuously formed with the shallow portion 118 and which has a depth (a vertical dimension shown in FIG. 19) that gradually increases; and a deep portion 120 which is continuously formed with the boundary portion 119. The deep portion 120 is not continuously formed with the front surface 117 of the cartridge body 111, whereby an end surface 121 is formed in the ink cartridge body 111 at the one of opposite sides of the deep portion 120 which is nearer to the front surface 117. In other words, each of the fitting recesses 116, 116 extends in a direction in which the ink cartridge 63 is inserted and withdrawn. In this arrangement, the pair of fitting recesses 116, 116 each having the end surface 121 which extends in the vertical direction are contiguous to the back surface 114 of the cartridge body 111, but not contiguous to the front surface 117 thereof. The end portion of the bent portion 97 of the respective pair of drawer portions 77, 77 are to be held in contact with the respective end surfaces 121, 121, as described later.

The cartridge body 111 has an upper portion 122 in which recesses 149, 149 are formed. As shown in FIG. 20, the recesses 149, 149 are formed on corner portions which are located on boundaries between the side plates and the upper side of the cartridge body 111, respectively, such that each of the recesses 149, 149 has a concaved shape which extends in the longitudinal direction of the cartridge body 111 and which is continuous with the front surface 117 and the back surface 114 of the cartridge body 111. On a boundary between each of the recesses 149, 149 and corresponding one of the side plates of the cartridge body 111, a curved surface 131 is formed. Further, on the upper side of the cartridge body 111, there is provided the pair of concave portions 134, 134 each of which has a substantially V-shape and each of which has the front inclined surface 135 and a rear inclined surface 136. As shown in FIGS. 6 and 10, in the case 75 in which the ink cartridge 63 is accommodated, there is provided the swing arm 123 which is elastically biased by the tension spring 128 such that the swing arm 123 is pivoted clockwise.

There will be described a movement of the swing arm 123 when the ink cartridge 63 is inserted into the case 75. Initially, when the ink cartridge 63 is inserted into the case 75, an upper rear end portion 148 of the cartridge body 111 is brought into contact with the second arm 126 of the swing arm 123, as shown in FIG. 10. Subsequently, in a movement in which the ink cartridge 63 is inserted into the case 75, the swing arm 123 is pivoted counterclockwise such that the swing arm 123 is held in a posture indicated by a solid line shown in FIG. 10. When the ink cartridge 63 is further inserted into the case 75, the swing arm 123 is pivoted clockwise while being guided by the rear inclined surfaces 136, 136 of one of the concave portions 134, 134 such that the swing arm 123 is fitted in said one of the concave portions 134, 134. Then, the second arm 126 of the swing arm 123 is pivoted counterclockwise again while being guided by the front inclined surfaces 135 of said one of the concaved portions 134, 134 such that the swing arm 123 is held in the posture indicated by the solid line shown in FIG. 10. Further, with the ink cartridge 63 being inserted into the case 75, the ink cartridge 63 is slid relative to the swing arm 123. Finally, the ink cartridge 63 is moved backward, by predetermined distance, from a position indicated by the solid line to a position which is further close to the rear side, whereby the ink cartridge 63 is completely accommodated in the case 75. It is noted that the above-described predetermined distance is indicated by "L1" in FIG. 6.

Figure 21A:
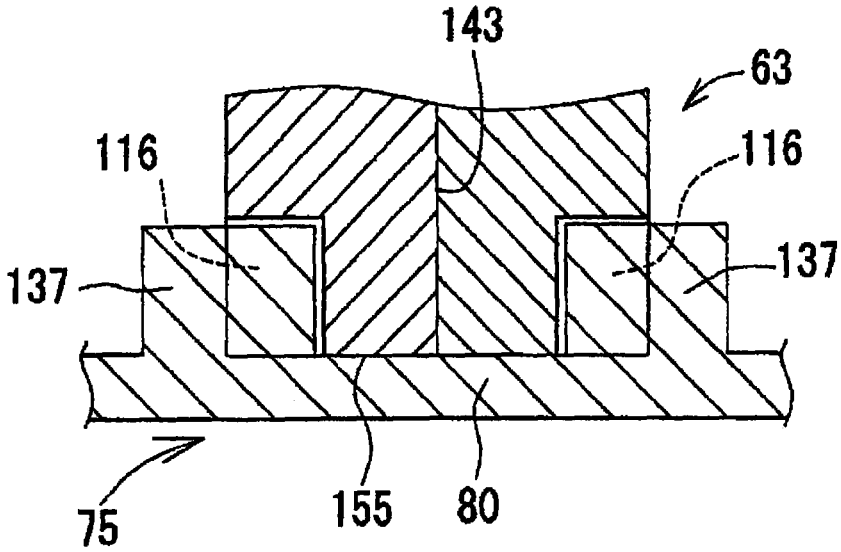
FIG. 21A is a view showing a structure for fitting a lower portion of the ink cartridge and a lower portion of the case to each other.
Figure 21B:
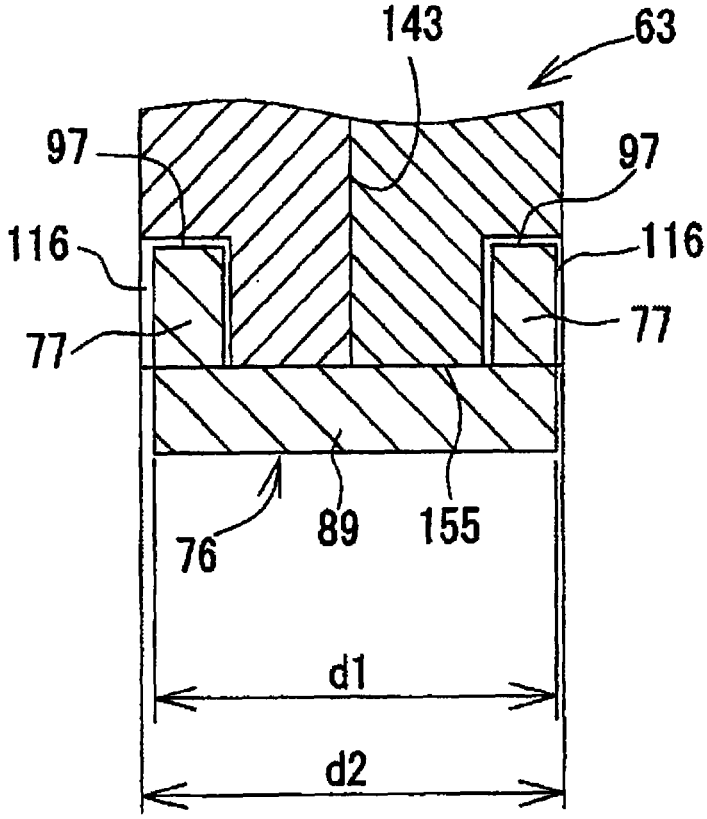
FIG. 21B is a view showing a structure for fitting the ink cartridge and a pair of drawer portions to each other.

As shown in FIG. 21A, where the ink cartridge 63 is accommodated in the case 75, the guide rail portions 137, 137 provided on the case 75 are fitted in the fitting recesses 116, 116, respectively. Also, the guide rail portions 137, 137 provided on the top wall portion 82 of the case 75 are fitted in the recesses 149, 149 formed on the upper portion 122 of the ink cartridge 63, respectively. In this state, the ink cartridge 63 is put on the bottom wall portion 80 of the case 75 such that the lower surface 165 of the ink cartridge 63 is held in contact with the upper surface of the bottom wall portion 80 of the case 75. Accordingly, the ink cartridge 63 is held and accommodated in a state in which the ink cartridge 63 is positioned in the case 75, as shown in FIG. 6. Further, as shown in FIG. 21B, if the ink cartridge 63 is accommodated in the case 75, the ink cartridge 63 is put on the door body 89 such that a lower side of the ink cartridge 63 is placed on the door body 89. In this state, the bent portions 97, 97 of the pair of drawer portions 77, 77 enter the fitting recesses 116, 116, respectively. In the state in which the ink cartridge 63 is accommodated in the case 75, when the door unit 76 is opened, the pair of drawer portions 77, 77 is pivoted such that the bent portions 97, 97 pull the end surfaces 121, 121 of the ink cartridge 63 forward, as shown in FIGS. 6 and 10.

In the MFD 10 in the present embodiment, the ink cartridge 63 which is used up will be replaced with a new ink cartridge in the following manner.

Initially, as shown in FIG. 14, if the door unit 76 is closed in the state in which the ink cartridge 63 is accommodated in the case 76, the locking member 91 has been slidably moved toward the protruding posture "S" such that the locking member 91 is brought into contact with an upper edge portion 130, i.e., a pressing portion, of the case 75, namely, the locking member 91 is displaced in the middle posture "M" and the door unit 76 is locked in the closed posture. Where the door unit 76 is held in the closed posture, the release lever 92 can be freely displaced from the neutral posture "N" to the accommodated posture "C". In this state, if the opening-closing lid 72 is closed, the inner surface of the opening-closing lid 72 is brought into contact with the release lever 92. More specifically, the opening-closing lid 72 is held in contact with the first engagement projection 159 and the convex portion 153 both of which are provided on the release lever 92. Where the opening-closing lid 72 is completely closed, the release lever 92 is pushed by the opening-closing lid 72 such that the release lever 92 is displaced in the accommodated posture "C". That is, an external dimension of the refill unit 70 becomes smaller where the opening-closing lid 72 is closed. Therefore, in the present embodiment, the MFD 10 can be downsized.

Further, when the opening-closing lid 72 is closed, the release lever 92 is pushed by the opening-closing lid 72 such that the release lever 92 is displaced in the accommodated posture "C" and such that a distance between the triangular projection 162 and the ink cartridge 63 is minimized. Therefore, if the MFD 10 in the present embodiment is moved in the state in which the ink cartridge 63 is accommodated in the corresponding accommodation 78, the ink cartridge 63 can be stably held in the corresponding accommodation 78. More specifically, in the state in which the distance between the triangular projection 152 and the ink cartridge 63 is minimized, a movement of the ink cartridge 63 in the corresponding accommodation 78 is limited because the ink cartridge 63 is held in contact with the triangular projection 152 when the ink cartridge 63 is to be moved in the corresponding accommodation 78. Therefore, if the MFD 10 in the present embodiment is moved in the state in which the ink cartridge 63 is accommodated in the corresponding accommodation 78, the movement of the ink cartridge 63 in the forward and backward directions is prevented. Accordingly, it is possible to reliably avoid the leakage of the ink from the ink supply valve 115 of the ink cartridge 63.

As shown in FIG. 1, in order to withdraw the ink cartridge 63 from the corresponding accommodation 78, the operator initially opens the opening-closing lid 72. By opening the opening-closing lid 72, the refill unit 70 is exposed in the front surface of the MFD 10. In the present embodiment, as described above, when the opening-closing lid 72 is opened, the release lever 92 of the refill unit 70 is displaced from the accommodated posture "C" to the neutral posture "N" such that the release lever 92 is inclined toward the front side of the MFD 10, as shown in FIG. 1. In the state in which the release lever 92 is held in the neutral posture "N", the operator can easily operate the release lever 92 because the release lever 92 is inclined in a direction in which the release lever 92 is away from the front face 79 of the case 75. Further, the first engagement projection 159 and the second engagement projection 160 project upwardly from the upper surface 151 of the release lever 92. More specifically, the first engagement projection 159 has the curved shape so as to correspond with a finger of the operator. In this arrangement, the finger of the operator is steadily supported by the first engagement projection 159 and the second engagement projection 160, whereby the operator can easily operate the release lever 92. That is, the finger of the use can easily catch the release lever 92 which is inclined forward from the front face 79 of the case 75 so that the operator can easily pivot the release lever 92 toward the laid posture "O". In the state in which the opening-closing lid 72 is opened and the door unit 76 of the refill unit 70 is closed, and in which the release lever 92 is held in the neutral posture "N", the operator is able to visually identify the release lever 92 where the operator stands in front of the MFD 10. Therefore, the operator can take the ink cartridge 63 out from the corresponding accommodation 78 by operating the release lever 92 without having a tough posture, such as squatting down. Further, on the upper surface 151 of the release lever 92, the arrow which indicates the operational direction of the release lever 92 is marked. Therefore, the operator can easily know the direction in which the release lever 92 is operated.

In this state, the operator opens the door unit 76 of the refill unit 70. To be more specific, the operator forwardly pushes down the release lever 92 (in a direction indicated by the arrow "T" in FIGS. 14, 15, 16, and 18B) with catching the first engagement projection 159 and the second engagement projection 160 by the finger. Therefore, the posture of the release lever 92 is changed to the laid posture "O". In this state, the finger of the operator engages with the triangular projection 152 and the second engagement projection 160. Therefore, the operator can reliably operate the release lever 92, thereby making it possible to prevent the collision between the door unit 76 and the finger of the operator caused by biasing forces of the retaining member 90 and the swing arm 123. More specifically, when the release lever 92 is displaced in the laid posture "O", the direction in which the door unit 76 is pivoted becomes almost perpendicular to the front face 92A of the release lever 92. In this state, the finger of the operator who is operating the release lever 92 tends to receive a force by which the door unit 76 is displaced from the closed posture to the open posture. However, since there the triangular projection 152 is provided on the release lever 92, the contact area between the finger of the operator and the release lever 92 is relatively large. Therefore, the operator can reliably support the release lever 92 by own finger, thereby making it possible to prevent the collision between the door unit 76 and the finger of the operator caused by the above-described biasing forces of the retaining member 90 and the swing arm 123. In above-described manner, the locking member 91 of the door unit 76 is slidably moved downward such that the locking portion 133 of the locking member 91 is released from a fitting hole 83, i.e., an engaged portion, of the case 75, as shown in FIG. 15. The operator goes on to pull the release lever 92 forward, and consequently, the door unit 76 is opened, as shown in FIG. 1. In the present embodiment, the fitting hole 83 is provided on the case 75. However, the fitting hole 83 may be provided on the box-like body which supports the case 75.

If the finger of the operator is released from the release lever 92 after the door unit 76 is opened, the locking member 91 is displaced to the protruding posture "S". Accordingly, the release lever 92 is displaced to the accommodated posture "C", whereby the release lever 92 is fitted in the accommodation 150 of the door body 89. After the door unit 76 is completely opened, as shown in FIG. 10, the first engagement projection 159 and the convex portion 153 of the release lever 92 are brought into contact with the opening-closing lid 72 (shown in FIGS. 1 and 6), whereby the longitudinal direction of the door unit 76 becomes almost in parallel to the horizontal direction. As a result, the operator can more easily attach the ink cartridge 63 to, and detach the same 63 from, the case 75.

Further, as shown in FIG. 8, the first engagement projection 159 and the convex portion 153 of the release lever 92 are contact with the inner surface of the opening-closing lid 72, whereby the position of the release lever 92 is stabilized in the vertical direction. In this state, the triangular projection 152 provided on the release lever 92 is kept to be protruded over the rear face 91B of the locking member 91. Also in this state, the extension line "L" of the inclined end surface 161 of the triangular projection 152 does not intersect with the locking portion 133 of the locking member 91. Therefore, when the ink cartridge 63 is withdrawn from the corresponding accommodation 78 by the operator, the ink cartridge 62 is moved along the inclined end surface 161 of the triangular projection 152, and passed above the locking portion 133 of the locking member 91, as shown in the FIG. 11. Accordingly, the ink cartridge can be smoothly detached from the corresponding accommodation without catching the locking portion 133.

Further, the locking portion 133 has the isosceles triangle shape if the upper surface thereof is viewed from the above in the FIGS. 12 and 13. If the ink cartridge 63 is slant toward the right side or left side of the refill unit 70 (i.e., in the leftward and rightward directions indicated in FIG. 5) when the ink cartridge 63 is moved along the inclined end surface 161 of the triangular projection 152 so as to pass above the locking portion 133 of the locking member 91, the ink cartridge can be smoothly detached from the corresponding accommodation without catching the locking portion 133.

In the present embodiment, the door body 89 slidably holds the locking member 91. To be more specific, the pair of slide rails 101, 101 of the door body 89 guides the locking member 91 such that the locking member 91 can be slidably moved. Therefore, the locking member 91 is capable of smoothly sliding. Further, since the locking member 91 is biased by the coil spring 100 toward the protruding posture "S" at all times, the locking member 91 is slidably moved toward the protruding posture "S" immediately after the door unit 76 is closed. Accordingly, the locking member 91 contacts with the case 75 at the position in which the locking member 91 is held in the middle posture "M". In this state, the locking member is held in the middle posture "M" by constantly receiving the elastic force of the coil spring 100, whereby the locking member 91 is reliably engaged with the case 75 such that the door unit 76 is locked in the closed posture. Therefore, it becomes easier for the operator to reliably replace the ink cartridge 63, more specifically, to reliably accommodate the ink cartridge 63 in the case 75 by closing the door unit 76.

In the present embodiment, as shown FIG. 17, the release lever 92 has the pressing portion 108 which displaces the locking member 91 such that the movement of the locking member 91 is linked with a movement of the release lever 92. As described above, in the present embodiment, a simple structure of displacement of the locking member 91 is established and an external dimension of the case 75 can be downsized, that is, the external dimension of the refill unit 70 can be downsized.

Since the movement of the locking member 91 is linked with the movement of the release lever 92, the release lever 92 is biased by the coil spring 100 so as to be automatically displaced toward the accommodated posture "C" where the locking member 91 is held in the protruding posture "S". Further, when the door unit 76 is opened and falls down, the door unit 76 is held in a posture in which the longitudinal direction of the door unit 76 is almost in parallel to the horizontal direction. In this state, as described above, it becomes easy for the operator to hold the ink cartridge 63 and to insert and withdraw the ink cartridge 63.

Further, as shown in FIG. 8, the first engagement projection 159 and the convex portion 153 of the release lever 92 are held in contact with the inner surface of the opening-closing lid 72, whereby the position of the release lever 92 is positioned in the vertical direction. In this state, the triangular projection 152 provided on the release lever 92 is kept to be protruded over the rear face 91B of the locking member 91. Also in this state, the extension line "L" of the inclined end surface 161 of the triangular projection 152 does not intersect with the locking portion 133 of the locking member 91. Therefore, if the ink cartridge 63 is withdrawn from the corresponding accommodation 78 by the operator, the ink cartridge 62 is stably moved along the inclined end surface 161 of the triangular projection 152, and passed above the locking portion 133 of the locking member 91, as shown in the FIG. 11. Accordingly, the ink cartridge can be smoothly detached from the corresponding accommodation without catching the locking portion 133.

Further, the contour of the locking portion 133 is defined by an isosceles triangle whose base is defined by an upper end of the main stem portion 132, in an upper plan view, i.e., in a view as seen in the downward direction in the FIGS. 12 and 13. If the ink cartridge 63 is slant toward the right side or left side of the refill unit 70 (i.e., in the leftward and rightward directions indicated in FIG. 5) when the ink cartridge 63 is moved along the inclined end surface 161 of the triangular projection 152 and passed above the locking portion 133 of the locking member 91, the ink cartridge can be smoothly detached from the corresponding accommodation without catching the locking portion 133.

In the present embodiment, the triangular projection 152 functions as the interference preventing portion for preventing an interference of the locking portion 133 of the locking member 91 with the withdrawal of the ink cartridge 63. More specifically, the triangular projection 152 prevents the ink cartridge 63 from being brought into contact with the locking member 91. Further, the triangular projection 152 may be configured so as to prevent the interference of the locking portion 133 of the locking member 91 with the withdrawal of the ink cartridge 63 by permitting the ink cartridge 63 to be slightly brought into contact with the locking portion 133 but not to be caught by the locking portion 133. In the present embodiment, the triangular projection 152 also prevents the interference of the locking portion 133 of the locking member 91 with the insertion of the ink cartridge 63.

As shown in FIG. 6, when the door unit 76 is displaced from the closed posture to the open posture, the pair of drawer portions 77, 77 are pivoted about the pivot shaft portions 94, 94, whereby each of the bent portions 97, 97 are brought into contact with the end surfaces 121, 121 of the ink cartridge 63, respectively, such that the ink cartridge 63 is pressed in the leftward direction (i.e., in the forward direction in FIG. 1). Accordingly, the ink cartridge 63 is withdrawn, by the predetermined distance "L1", from the opening 88 of the case 75. Therefore, the operator can easily hold the ink cartridge 63, whereby the operator can easily draw out the ink cartridge 63.

Next, a new ink cartridge 63 is inserted from the opening 88 into the accommodation 78 of the case 75. In this state, the door unit 76 is held in the open posture and the new ink cartridge which is to be inserted into the accommodation 78 is put on, in advance, the outer surfaces 110, 110 of the pair of bent portion 97, 97 of the pair of drawer portions 77, 77. The new ink cartridge 63 is inserted into the accommodation 78 while being guided by the outer surfaces 110, 110 and the guide wall portions 68 which are provided inside of the case 75. Especially, in the present embodiment, the retaining member 90 is provided on the door unit 76. Therefore, the new ink cartridge 63 is temporarily put on the pair of projections, 141, 142 of the main surface 84 of the retaining member 90. Then, the new ink cartridge 63 is slidably moved along the pair of projections, 141, 142 and guided above the outer surfaces 110, 110 of the above-described respective pair of bent portion 97, 97.

Further, in the present embodiment, each of the guide wall portions 68 extends from the corresponding partition wall portion 67. Therefore, if the new ink cartridge is inclinedly inserted, at least one of the curved surfaces 131, 131 of the new ink cartridge 63 is brought into contact with at least one of the guide wall portions 68, whereby a course of insertion of the new ink cartridge is corrected. Accordingly, a rear end portion of the new ink cartridge 63 is accommodated between a corresponding one of the pair of side wall portions 81, 81 and a corresponding one of the partition wall portions 67, 67 of the case 75, or, between corresponding two of the partition wall portions 67, 67. Therefore, the operator can insert the new ink cartridge 63 into the accommodation 78 without concern about a position of the partition wall portions 67, and set the new ink cartridge at a right position in the accommodation 78. Further, each of the guide wall portions 68 has a tapered shape whose degree of taper is reduced in a direction toward the opening 88. Therefore, the new ink cartridge 63 can be smoothly moved along at least one of the guide wall portions 68.

Further, in the present embodiment, the predetermined dimension, "W1", of the partition wall portion 67 in forward and backward directions is slightly longer than a predetermined distance "L1+L2" at which the ink cartridge 63 is withdrawn from the opening 88 of the case 75 in the state in which the door unit 76 is opened. Therefore, a rear end portion of the new ink cartridge 63 is disposed, at a position in which the operator can insert the same 63 by hand, between the corresponding one of the pair of side wall portions 81, 81 and the corresponding one of the partition wall portions 67, 67, or, between the corresponding two of the partition wall portions 67, 67. That is, after the rear end portion of the new ink cartridge 63 is disposed between the corresponding one of the pair of side wall portions 81, 81 and the corresponding one of the partition wall portions 67, 67, or, between the corresponding two of the partition wall portions 67, 67, the operator can displace the door unit 76 from the open posture to the closed posture. Accordingly, the operator can insert the new ink cartridge 63, at a right position, into the accommodation 78.

In this state, the operator again displaces the door unit 76 from the open posture to the closed posture. Also in this state, the release lever 92 is held in the accommodated posture "C". From the front face 92A of the release lever 92, as described above, the convex portion 153 and the first engagement projection 159 are projected. Between the first engagement projection 159 and the convex portion 153, the concave portion 163 is interposed. Owing to the convex portion 153, the operator can sensibly recognize a portion of the release lever 92 which should be pushed by the operator in order to displace the door unit 76 to the closed posture. When the door unit 76 is pivoted by the operator toward the closed posture, the retaining member 90 is brought into contact with the front surface 117 of the new ink cartridge 63. Accordingly, the new ink cartridge 63 is further moved toward the rear side of the accommodation 78, i.e., moved in the backward direction in the accommodation 78. Then, the push rod 85A provided on the air-introducing valve 85 of the back side of the new ink cartridge 63 is held in contact with the rear wall portion 69 of the case 75.

If the door unit 76 is further pivoted toward the closed posture, the steep slant portion 103A of the upper surface 103 of the locking portion 133 of the locking member 91 is brought into contact with the upper edge portion 130 of the case 75. In this state, the push rod 85A is pushed back, by a predetermined distance, into inside of the ink cartridge 63. Subsequently, when the door unit 76 is further pivoted toward the closed posture in this state, the upper edge portion 130 of the case 75 is relatively moved along the steep slant portion 103A of the upper surface 103 of the locking portion 133 of the locking member 91 by passing a middle portion of the upper surface 103 toward the gradual slant portion 103B of the upper surface 103. At the same time, since the upper surface 103 of the locking portion 133 of the locking member 91 is pressed by the upper edge portion 130 of the case 75, the locking member 91 is moved back to the inside of the door body 89. Meanwhile, since the push rod 85A is further pushed back, at by a predetermined distance, into inside of the ink cartridge 63, the air is introduced, via the air-introducing valve 85, into the inside of the ink cartridge 63. Accordingly, the ink supply valve 115 of the ink cartridge 63 is connected to the ink supply tube, not shown.

If the door unit 76 is further pivoted toward the closed posture in this state, the upper edge portion 130 of the case 75 is relatively moved along the gradual slant portion 103B of the upper surface 103 of the locking portion 133 of the locking member 91 by passing a top portion of the upper surface 103 toward the step portion 103C of the upper surface 103. In this state, the locking member 91 is protruded again over the door body 89 due to the biasing force of the coil spring 100. Accordingly, the locking portion 133 of the locking member 91 is fitted into the fitting hole 83 provided in the case 75, whereby the door unit 76 is held in the closed posture.

As described above, the steep slant portion 103A and the gradual slant portion 103B are integrally formed so as to form the continuous curved surface in which the inclination thereof becomes smaller in the gradual slant portion 103B than in the steep slant portion 103A. Therefore, where a pressing force by which the operator displaces the door unit 76 toward the closed posture is constant, a speed of the movement of the door unit 76 is changed according to variation of the inclination of the above-described continuous curved surface integrally formed by the steep slant portion 103A and the gradual slant portion 103B. In other words, the speed of the movement of the door unit 76 becomes faster as the upper edge portion 130 of the case 75 is relatively moved along the steep slant portion 103A of the upper surface 103 by passing the middle portion of the upper surface 103 toward the gradual slant portion 103B of the upper surface 103.

After the air-introducing valve 85 is opened till the ink supply valve 115 of the ink cartridge 63 is connected to the ink supply tube (not shown), the upper edge portion 130 of the case 75 is moved along the steep slant portion 103A of the upper surface 103. In this state, as compared with a movement in which the upper edge portion 130 of the case 75 is moved along the gradual slant portion 103B of the upper surface 103, the door unit 76 is slowly moved toward the closed posture, whereby the ink supply valve 115 of the ink cartridge 63 is connected to the ink supply tube (not shown) after the air is sufficiently introduced, via the air-introducing valve 85, into the inside of the ink cartridge 63. Therefore, the air is prevented from entering from the recording head 27 into the ink cartridge 63, whereby bubbles are prevented from being generated in the recording head 27 and the ink supply tubes.

Owing to a positional relationship between the convex portion 153, the concave portion 163, and the first engagement projection 159 in the release lever 92, the release lever 92 is formed in a shape which is matched with a shape of the finger. The finger of the operator is fitted in the above-described shape formed by the convex portion 153, the concave portion 163, and the first engagement projection 159, whereby the pressing force of the operator for displacing the door unit 76 toward the closed posture is efficiently transmitted to the door unit 76. Therefore, the operator can easily displace the door unit 76 with a small pressing force.

Since the first engagement projection 159 projects from the front face 92A of the release lever 92 by a larger distance than the convex portion 163, the finger of the operator can be reliably caught or supported by the first engagement projection 159. Therefore, the operator can reliably displace the door unit 76 toward the closed posture. Further, even if the release lever 92 is held in any one of the accommodated posture "C", the neutral posture "N", or the laid posture "O", the convex portion 153 is protruded from the front face 105 of the door body 89 over the seat portion 109 of the locking member 91. Therefore, the finger of the operator is prevented from being held in contact with the seat portion 109. In other words, since the finger of the operator is prevented from being held in contact with the seat portion 109, interference with the movement of the locking member 91 in the upward and downward directions is accordingly prevented. Therefore, the operator can reliably displace the door unit 76 with a small pressing force.

Further, since three ridges 162 are provided on the convex portion 153 of the release lever 92, the operator can sensibly recognize a portion of the release lever 92 which should be pushed by the operator in order to displace the door unit 76 to the closed posture. Moreover, owing to ridges 162, the finger of the operator can be prevented from slipping over the door unit 76 when the operator is intended to displace the door unit 76 to the closed posture. Therefore, the pressing force of the operator for displacing the door unit 76 toward the closed posture is efficiently transmitted to the door unit 76. However, the shape of the convex portion 153 of the release lever 92 is not limited to the above-described detail in the present embodiment. The convex portion 153 may have a covering portion 200 (shown in FIGS. 18A and 18B) which extends from the convex portion 153 of the release lever 92 to completely cover the seat portion 109 of the locking member 91. Owing to the covering portion 200, the finger of the operator is more reliably prevented from being held in contact with the seat portion 109. In other words, since the finger of the operator is prevented from being held in contact with the seat portion 109, the interference with the movement of the locking member 91 in the upward and downward directions is accordingly prevented. Accordingly, the locking portion 133 of the locking member 91 is reliably fitted into the fitting hole 83 provided in the case 75.

When the door unit 76 is pivoted by the operator toward the closed posture, the retaining member 90 is brought into contact with the front surface 117 of the ink cartridge 63. In the state in which the door unit 76 is completely in the closed posture, the ink cartridge 63 is elastically biased by the retaining member 90 toward the rear side of the accommodation 78, i.e., biased in the backward direction in the accommodation 78. At the same time, the locking portion 133 of the locking member 91 is fitted into the fitting hole 83 provided in the case 75, whereby the door unit 76 is held in the closed posture. In this state, when the opening-closing lid 72 is closed, the inner surface of the opening-closing lid 72 is brought into contact with the release lever 92, more specifically, brought into contact with the first engagement projection 159 and the convex portion 153 of the release lever 92, whereby the release lever 92 is pressed by the opening-closing lid 72 so as to be held in the accommodated posture "C". In this state, the triangular projection 152 is located so as to be extremely near to the ink cartridge 63. Therefore, if the MFD 10 in the present embodiment is moved in the state in which the ink cartridge 63 is accommodated in the corresponding accommodation 78, the ink cartridge 63 can be stably held in the corresponding accommodation 78. More specifically, in the state in which the distance between the triangular projection 152 and the ink cartridge 63 is minimized, the movement of the ink cartridge 63 in the corresponding accommodation 78 is limited because the ink cartridge 63 is held in contact with the triangular projection 152 when the ink cartridge 63 is moved in the corresponding accommodation 78.

In the present embodiment, the MFD 10 further has following effects.

In the present embodiment, when the operator opens the door unit 76 of the refill unit 70, the ink cartridge 63 in which the ink is used up is automatically withdrawn. Further, with the door kept being opened, the operator can easily accommodate the new ink cartridge 63 into the accommodation 78 of the case 76. Therefore, it is very easy for the operator to replace the ink cartridge 63.

In the present embodiment, as shown in FIG. 10, the swing arm 123 is disposed on the top wall portion 82 of the case 75. In the state in which the ink cartridge 63 is withdrawn, by the predetermined distance "L1", from the case 75, the front inclined surface 135 of the corresponding one of the concave portions 134, 134 is pressed down by the swing arm 123. In this state, the elastic force of the tension spring 128 acts on the front inclined surface 135 of the cartridge body 111, whereby the ink cartridge 63 is elastically biased in a direction toward the opening 88 of the case 75. Therefore, when the ink cartridge 63 is withdrawn by the drawer portions 77, 77 from the opening 88 of the case 75 after the door unit 76 is opened, the swing arm 123 is concurrently pivoted clockwise so as to press down the front inclined surface 135 toward the opening 88. Accordingly, the swing arm 123 is located into a corresponding one of the concave portions 134, 134 which is defined by the corresponding one of the front inclined surfaces 135, 135 and the corresponding one of the rear inclined surfaces 136, 136. Also, the second arm 126 of the swing arm 123 is held in contact with the corresponding one of the front inclined surfaces 135, 135. In other words, the swing arm 123 is supported by the one of the concave portions 134, 134.

Since the swing arm 123 is pivoted so as to fit in the one of the concave portions 134, 134, the ink cartridge 63 is further withdrawn from the case 75 by a predetermined distance, "L2". Therefore, the ink cartridge 63 is withdrawn from the case 75 by the predetermined distance, "L1+L2" in all, whereby the operator can easily hold the ink cartridge 63 in which the ink is used up. Accordingly, the ink cartridge 63 is still easier to be detached from the case 75.

In the present embodiment, in the door unit 76, there is provided the pair of drawer portions 77, 77 between which the ink cartridge 63 is inserted in the backward direction, as shown in FIG. 21. Therefore, the ink cartridge 63 is withdrawn from the opening 88 of the case 75 with being positioned by the pair of drawer portions 77, 77 in the widthwise direction. As shown in FIGS. 10 and 11, the bent portion 97 of each of the drawer portions 77, 77 is disposed such that the longitudinal direction of the door unit 76 becomes almost in parallel to the horizontal direction as if the door unit 76 were smoothly continuous with the placing surface 98 on which the ink cartridge 63 is to be put. Therefore, when the new ink cartridge 63 is inserted from the opening 88 into the accommodation 78, the new ink cartridge 63 is temporarily put on the outer surfaces 110, 110 of the respective pair of bent portion 97, 97 so as to be reliably supported by the pair of drawer portions 77, 77. With being supported by the pair of drawer portions 77, 77, the ink cartridge 63 is guided by the pair of drawer portions 77, 77 onto the placing surface 98. Therefore, the operator can more easily replace the ink cartridge 63.

In addition, the pair of drawer portions 77, 77 are fitted in the pair of fitting recesses 116, 116 which are concavely formed on the ink cartridge 63, respectively. Since the width, "d1", of the pair of drawer portions 77, 77 (shown in FIG. 12) is set to be smaller than the width, "d2", of the ink cartridge 63 (shown in FIG. 20), the pair of drawer portions 77, 77 does not protrude from the ink cartridge 63. Owing to the above-described arrangement, the door unit 76 is made in a compact size, thereby making it possible to downsize the refill unit 70, and also to downsize the MFD 10.

In the present embodiment, the refill unit 70 is disposed on the front side of the MFD 10. In this arrangement, since the operator can insert and withdraw the ink cartridge 63 into and from the refill unit 70 by facing the front side of the MFD 10, it is easier for the operator to replace the ink cartridge 63. As shown in FIG. 11, the bent portions 97, 97 of the drawer portions 77, 77 are pivoted as the door unit 76 is displaced in the open posture, so that the bent portions 97, 97 presses down the end surfaces 121, 121 of the ink cartridge 63, respectively. Accordingly, the ink cartridge 63 is withdrawn from the case 75. Also, the drawer portions 77, 77 guide the new ink cartridge 63 to be inserted into the case 75. As a result, the operator can more easily replace the ink cartridge 63.

In the present embodiment, the distal end 165 of each of the partition wall portions 67 is located at the position away from the proximal end thereof, i.e., the rear wall portion 69 of the case 75, by predetermined distance, "W1", toward the corresponding opening 88. Therefore, even if an external dimension of the case 75 in the rightward and leftward direction, i.e., the rear wall portion 69 of the case 75, in the horizontal direction is downsized, the draft of the partition wall portions 67 is not so much influenced. Therefore, the thickness of each of the distal ends 165 of the corresponding partition wall portions 67 is adequately secured. In other words, not only strength of each of the partition wall portions 67 can be adequately secured but the external dimension of the refill unit 70 in the horizontal direction can be downsized as well, thereby making it possible to make the MFD 10 in the compact size.

Further, in the present embodiment, the distal end 165 of each of the partition wall portions 67 is disposed in a vicinity of the rear wall portion 69, the bottom wall portion 80, and the top wall portion 82 of the case 75. Since the rear wall portion 69, the bottom wall portion 80, and the top wall portion 82 of the case 75 function as a large resin channel when the case 75 is molded by using the die assembly, the distal end 165 of each of the partition wall portions 67 is reliably filled with the resin. Accordingly, it is easy to form the partition wall portions 67 and the guide wall portions 68, both of which have high rigidity.

Figure 7B:
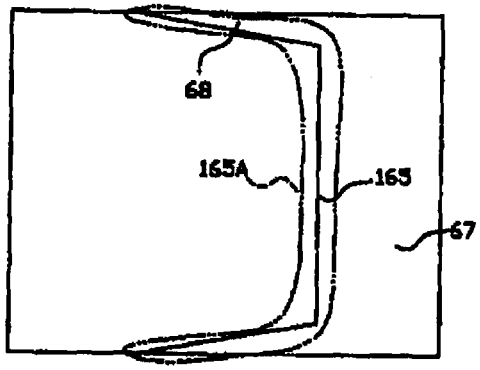
FIG. 7B is a view showing a shape of the partition wall as another one of various examples.
Figure 7C:
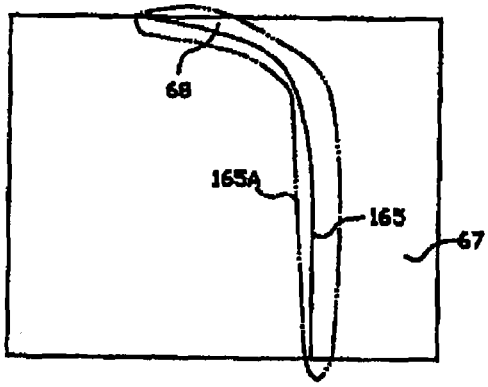
FIG. 7C is a view showing a converted shape of the partition wall as another one of various examples.
Figure 7D:
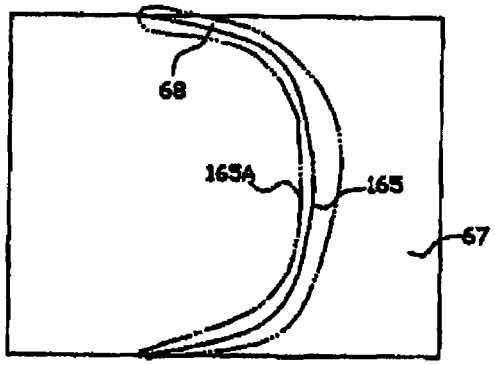
FIG. 7D is a view showing a converted shape of the partition wall as another one of various examples.
Figure 7E:
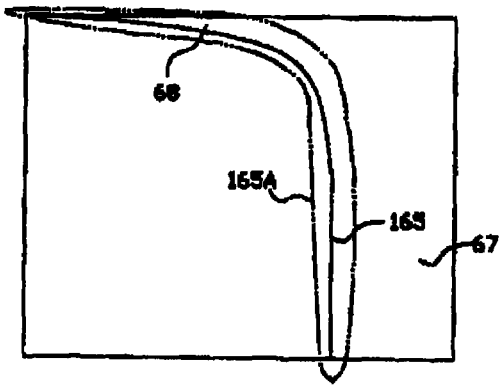
FIG. 7E is a view showing a shape of the partition wall as another one of various examples.
Figure 7F:
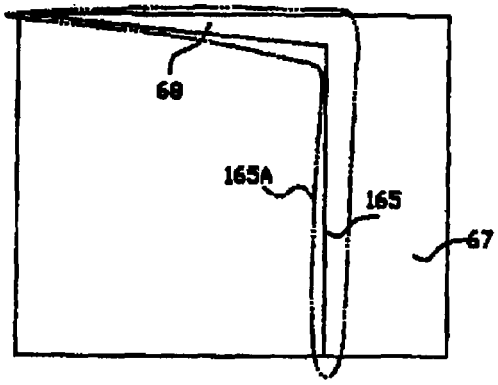
FIG. 7F is a view showing a shape of the partition wall as another one of various examples.

Further, in the present embodiment, each of the guide wall portions 68 extends from the corresponding partition wall portion 67. However, as shown in FIG. 7C, effects of the partition wall portions 67 in the above-described arrangement may be obtained as well in an arrangement in which each of the distal ends 165 may be defined as a curved line. Also, as shown in FIGS. 7B and 7D, each of the partition wall portions 67 may have two guide wall portions 68, 68. One of the two guide wall portions 68, 68 may be close to the top wall portion 82 of the case 75, and the other of the two guide wall portions 68, 68 may be close to the bottom wall portion 80 of the case 75. In this arrangement, each of a curved surface 131 provided in the upper side and a curved surface 131 provided in the lower side of the ink cartridge 63 is held in contact with a corresponding one of the guide wall portions 68, whereby the ink cartridge 63 can be more smoothly moved along the two guide wall portions 68, 68 in the backward direction in which the ink cartridge 63 is inserted into the corresponding accommodation 78. Further, as shown in FIGS. 7E and 7F, each of the guide wall portions 68 may extend from the corresponding partition wall portion 67 to a vicinity of the corresponding opening 88 so as to reach the opening 88. In this arrangement, each of the curved surface 131 provided in the upper side and the curved surface 131 provided in the lower side of the ink cartridge 63 is held in contact with a corresponding guide wall portion 68 in the state in which the back surface 114 of the ink cartridge 63 is inserted into the vicinity of the corresponding opening 88. Accordingly, the rear end portion of the ink cartridge 63 is more reliably disposed between one of the pair of side wall portions 81, 81 and a corresponding partition wall portion 67 of the case 75, or, between corresponding two of the partition wall portions 67, 67.

While the preferred embodiment of this invention has been described above, it is to be understood that the invention is not limited to the details of the illustrated embodiment, but may be embodied with various changes and modifications, which may occur to those skilled in the art, without departing from the sprit and scope of the present invention.

Also, the present invention may be applied to not only a multi-functional image recording apparatus, such as MFD 10 in the present embodiment, but also a mono-functional image recording apparatus. In the mono-functional image recording apparatus employing the present invention, similar effects to those obtained in the multi-functional image recording apparatus may be obtained as well.

What is claimed is:

1. An ink cartridge holding device for holding an ink cartridge, comprising:

a holder holding the ink cartridge and having an opening so as to allow the ink cartridge to be inserted thereinto and withdrawn therefrom through the opening;

a door which is attached to the holder and is pivotable between (a) an open position at which the opening is uncovered for permitting insertion and withdrawal of the ink cartridge through the opening into and from the holder and (b) a closed position at which the opening is covered for inhibiting the insertion and withdrawal of the ink cartridge through the opening;

a locking member which is attached to the door for locking the door at the closed position; and an interference preventing portion which is provided at the door for preventing an interference of the locking member with the withdrawal of the ink cartridge when the door is placed at the open position, wherein the locking member is displaceable relative to the door, and wherein the locking member has an engaging portion being located at a position in which the engaging portion engages with an engaged portion provided on the holder so as to lock the door at the closed position, while being released from the engaged portion due to displacement of the locking member so as to permit the door to be pivoted toward the open position.

2. The ink cartridge holding device according to claim 1, wherein the interference preventing portion is provided for preventing an interference of the engaging portion of the locking member with the withdrawal of the ink cartridge.

3. The ink cartridge holding device according to claim 1, wherein the locking member is attached to the door such that at least a part of the engaging portion protrudes from the door toward an interior of the holder when the door is placed at the closed position.

4. The ink cartridge holding device according to claim 1, wherein the door is pivotably attached, at one of opposite end portions thereof, to the holder, and wherein the locking member is attached to the door such that the engaging portion is located on the other of the opposite end portions of the door.

5. The ink cartridge holding device according to claim 4, wherein the locking member is attached to the door such that the engaging portion is displaceable in a direction substantially parallel to a line which connects the opposite end portions of the door to each other.

6. The ink cartridge holding device according to claim 1, wherein the locking member is attached to the door such that the engaging portion is displaceable in a direction substantially parallel to a direction in which the ink cartridge is insertable into and withdrawable from the holder.

7. The ink cartridge holding device according to claim 1, wherein the locking member has an accommodating portion accommodating the interference preventing portion with a clearance which allows the locking member to be displaced relative to the interference preventing portion so as to change a distance from the interference preventing portion to an interference portion of the locking member that is supposed to interfere with the withdrawal of the ink cartridge, and wherein the interference preventing portion is arranged to prevent the interference of the locking member with the withdrawal of the ink cartridge in a case in which the distance from the interference preventing portion to the interference portion of the locking member is minimized.

8. The ink cartridge holding device according to claim 1, further comprising a releasing member which is movably attached to the door, the releasing member being moved to cause displacement of the locking member, by which the engaging portion of the locking member is released from the engaged portion of the holder, and wherein the interference preventing portion is provided as a part of the releasing member.

9. The ink cartridge holding device according to claim 8, wherein the releasing member is attached to a front face of the door which is opposite to a rear face that faces an interior of the holder, and is pivotable about a pivot axis thereof between (a) a first posture in which one of opposite end portions of the releasing member that is away from the pivot axis is close to the door and (b) a second posture in which said one of the opposite end portions of the releasing member is away from the door, the second posture being established by pivot movement of the releasing member to release the engaging portion of the locking member from the engaged portion of the holder, wherein the ink cartridge holding device has an aperture through which the part of the releasing member is to be inserted so as to be protruded from the rear face of the door, and wherein the part of the releasing member is protruded from the rear face of the door so as to function as the interference preventing portion when the releasing member is held in the first posture.

10. The ink cartridge holding device according to claim 9, wherein the releasing member is arranged to be held in the first posture when the door is at the open position.

11. The ink cartridge holding device according to claim 9, wherein the releasing member has a pressing portion which is brought into contact with a contact portion that is a portion of the locking member so as to press the locking member, and the ink cartridge holding device further comprising an inter-dependent mechanism which is constituted by including the pressing portion of the releasing member and the contact portion of the locking member, and which displaces the locking member such that the engaging portion of the locking member is released from the engaged portion of the holder by the pressing portion that is pressed against the contact portion in accordance with pivot movement of the locking member from the first posture to the second posture.

12. The ink cartridge holding device according to claim 11, further comprising a biasing mechanism which is provided on the door and which generates a biasing force to bias the locking member in a direction opposite to a direction in which the engaging portion of the locking member is released from the engaged portion of the holder, wherein the inter-dependent mechanism displaces the locking member such that the engaging portion of the locking member is released from the engaged portion of the holder against the biasing force of the biasing mechanism.

* * * * *